US012623126B2

(12) United States Patent
Yi et al.

(10) Patent No.: US 12,623,126 B2
(45) **Date of Patent: *May 12, 2026**

(54) GOLF CLUB HAVING AN ADJUSTABLE WEIGHT ASSEMBLY

(71) Applicant: Acushnet Company, Fairhaven, MA (US)

(72) Inventors: Sang Yi, Carlsbad, CA (US); Richard L. Cleghorn, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 98 days.

This patent is subject to a terminal disclaimer.

(21) Appl. No.: 18/422,621

(22) Filed: Jan. 25, 2024

(65) Prior Publication Data

US 2024/0181310 A1 Jun. 6, 2024

Related U.S. Application Data

(63) Continuation of application No. 17/863,328, filed on Jul. 12, 2022, now Pat. No. 11,925,841.

(51) Int. Cl.
*A63B 53/06* (2015.01)
*A63B 53/08* (2015.01)
*A63B 53/04* (2015.01)

(52) U.S. Cl.
CPC ..... *A63B 53/06* (2013.01); *A63B 53/08* (2013.01); *A63B 2053/0491* (2013.01)

(58) Field of Classification Search
CPC ..... A63B 2053/0491; A63B 2053/0495
See application file for complete search history.

(56) References Cited

U.S. PATENT DOCUMENTS 645,942 A * 3/1900 Cran ..... A63B 53/047 473/336
2,155,830 A 4/1939 Howard
4,340,230 A * 7/1982 Churchward ..... A63B 53/04 473/339
5,769,737 A 6/1998 Holladay
6,811,496 B2 * 11/2004 Wahl ..... A63B 53/047 473/345
6,923,734 B2 * 8/2005 Meyer ..... A63B 60/02 473/341
7,083,530 B2 * 8/2006 Wahl ..... A63B 53/047 337/350
7,166,041 B2 * 1/2007 Evans ..... A63B 53/0466 473/335
7,611,424 B2 * 11/2009 Nagai ..... A63B 60/02 473/335
7,704,163 B2 * 4/2010 Stites ..... A63B 53/047 473/334
7,775,905 B2 8/2010 Beach
(Continued)

FOREIGN PATENT DOCUMENTS

FR 2581320 A1 * 11/1986 ..... A63B 53/0433
GB 1387955 A * 3/1975 ..... A63B 53/047
(Continued)

*Primary Examiner* — Alvin A Hunter
(74) *Attorney, Agent, or Firm* — Randy K. Chang

(57) ABSTRACT

The present invention relates to a golf club head having an adjustable weight assembly. More specifically, the adjustable weight assembly utilizes a weight member that's secured via a fastener along various positions within an elongate channel.

15 Claims, 31 Drawing Sheets

(56) References Cited

U.S. PATENT DOCUMENTS

| | | | | |
|---|---|---|---|---|
| 8,016,694 | B2 | 9/2011 | Llewellyn | |
| 8,337,325 | B2 * | 12/2012 | Boyd | A63B 60/02 473/332 |
| 8,696,491 | B1 * | 4/2014 | Myers | A63B 60/02 473/345 |
| 9,211,453 | B1 * | 12/2015 | Foster | A63B 53/06 |
| 9,259,627 | B1 * | 2/2016 | Myers | A63B 53/04 |
| 9,289,660 | B1 | 3/2016 | Myers | |
| 9,597,561 | B1 | 3/2017 | Seluga | |
| 9,623,294 | B1 | 4/2017 | Kingston | |
| 9,623,302 | B1 * | 4/2017 | Myers | A63B 53/0466 |
| 9,636,553 | B1 | 5/2017 | Myers | |
| 9,682,298 | B1 | 6/2017 | Kingston | |
| 9,694,256 | B2 * | 7/2017 | Myers | A63B 53/0466 |
| 9,724,577 | B1 | 8/2017 | Kingston | |
| 9,914,028 | B1 | 3/2018 | Cleghorn | |
| 9,975,019 | B2 | 5/2018 | Frame | |
| 10,022,602 | B2 | 7/2018 | Kingston | |
| 10,213,665 | B1 * | 2/2019 | Day | A63B 53/0466 |
| 10,434,385 | B2 | 10/2019 | Mine | |
| 10,543,406 | B2 * | 1/2020 | Carter | A63B 53/0466 |
| 10,556,161 | B2 | 2/2020 | Jertson | |
| 10,596,428 | B1 * | 3/2020 | Rumble | A63B 60/02 |
| 10,695,628 | B1 * | 6/2020 | Yi | A63B 53/08 |
| 10,926,143 | B2 * | 2/2021 | Bennett | A63B 60/02 |
| 10,974,109 | B2 * | 4/2021 | Stokke | A63B 53/0433 |
| 11,033,782 | B1 * | 6/2021 | Evans | A63B 53/04 |
| 11,052,294 | B2 * | 7/2021 | Carter | A63B 60/00 |
| 11,090,536 | B2 * | 8/2021 | Bennett | A63B 53/08 |
| 11,229,827 | B2 | 1/2022 | Yi | |
| 11,439,877 | B2 * | 9/2022 | Northcutt | A63B 60/04 |
| 11,439,878 | B2 * | 9/2022 | Bennett | A63B 53/047 |
| 11,439,879 | B2 * | 9/2022 | Yi | A63B 60/52 |
| 11,497,974 | B2 * | 11/2022 | Northcutt | A63B 53/0466 |
| 11,684,830 | B2 * | 6/2023 | Mizutani | A63B 53/0466 473/345 |
| 11,691,057 | B2 * | 7/2023 | Bennett | A63B 53/08 473/335 |
| 11,911,672 | B1 * | 2/2024 | Hettinger | A63B 53/06 |
| 11,925,841 | B2 * | 3/2024 | Yi | A63B 53/0466 |
| 12,005,327 | B2 * | 6/2024 | Hettinger | A63B 60/02 |
| 12,102,895 | B2 * | 10/2024 | Funaki | A63B 53/0466 |
| 12,246,227 | B2 * | 3/2025 | Bennett | A63B 53/08 |
| 2006/0058112 | A1 | 3/2006 | Haralason | |
| 2006/0122004 | A1 | 6/2006 | Chen | |
| 2006/0172821 | A1 | 8/2006 | Evans | |
| 2006/0178229 | A1 | 8/2006 | Liang et al. | |
| 2006/0240908 | A1 | 10/2006 | Adams | |
| 2008/0020861 | A1 * | 1/2008 | Adams | A63B 60/00 473/336 |
| 2008/0146370 | A1 | 6/2008 | Beach | |
| 2008/0261715 | A1 | 10/2008 | Carter | |
| 2010/0007577 | A1 | 1/2010 | Ninan | |
| 2010/0075773 | A1 | 3/2010 | Casati | |
| 2011/0009209 | A1 | 1/2011 | Llewellyn | |
| 2012/0202615 | A1 | 8/2012 | Beach | |
| 2013/0344976 | A1 | 12/2013 | Stites | |
| 2015/0038258 | A1 | 2/2015 | Beach | |
| 2015/0297961 | A1 | 10/2015 | Voshall | |
| 2015/0306473 | A1 | 10/2015 | Breier | |
| 2015/0306474 | A1 | 10/2015 | Breier | |
| 2015/0306475 | A1 | 10/2015 | Curtis | |
| 2016/0129323 | A1 * | 5/2016 | Myers | A63B 53/0466 473/338 |
| 2017/0173413 | A1 | 6/2017 | Cleghorn | |
| 2017/0173420 | A1 | 6/2017 | Frame | |
| 2018/0065005 | A1 | 3/2018 | Cleghorn | |
| 2018/0117428 | A1 | 5/2018 | Hebreo | |
| 2019/0083862 | A1 | 3/2019 | Jertson | |
| 2019/0118050 | A1 | 4/2019 | Cleghorn | |
| 2019/0192928 | A1 * | 6/2019 | Soracco | A63B 60/04 |
| 2020/0129821 | A1 | 4/2020 | Sanchez | |
| 2020/0129822 | A1 | 4/2020 | Cleghorn | |
| 2020/0330834 | A1 * | 10/2020 | Northcutt | A63B 53/045 |
| 2020/0330835 | A1 * | 10/2020 | Bennett | A63B 53/06 |
| 2020/0330836 | A1 * | 10/2020 | Bennett | A63B 60/02 |
| 2021/0069560 | A1 | 3/2021 | Jertson | |
| 2021/0086042 | A1 | 3/2021 | Story | |
| 2021/0128994 | A1 * | 5/2021 | Yi | A63B 53/047 |
| 2021/0138318 | A1 * | 5/2021 | Northcutt | A63B 53/0466 |
| 2021/0138319 | A1 * | 5/2021 | Bennett | A63B 53/047 |
| 2021/0299525 | A1 * | 9/2021 | Mizutani | A63B 53/04 |
| 2021/0402270 | A1 * | 12/2021 | Bennett | A63B 60/02 |
| 2022/0111263 | A1 * | 4/2022 | Yi | A63B 53/0433 |
| 2023/0233911 | A1 | 7/2023 | Carr | |
| 2023/0271066 | A1 * | 8/2023 | Mizutani | A63B 53/0466 473/345 |
| 2023/0285817 | A1 * | 9/2023 | Bennett | A63B 60/02 |
| 2023/0330499 | A1 * | 10/2023 | Yi | A63B 60/52 |
| 2023/0338794 | A1 * | 10/2023 | Hettinger | A63B 53/047 |
| 2024/0066366 | A1 * | 2/2024 | Yi | A63B 53/047 |
| 2024/0066367 | A1 * | 2/2024 | Hettinger | A63B 60/02 |
| 2024/0066368 | A1 * | 2/2024 | Ines | A63B 53/08 |
| 2024/0157206 | A1 * | 5/2024 | Hettinger | A63B 53/047 |
| 2024/0226673 | A1 * | 7/2024 | Cleghorn | A63B 60/02 |
| 2024/0316420 | A1 * | 9/2024 | Yi | A63B 53/08 |
| 2024/0316422 | A1 * | 9/2024 | Yi | A63B 60/52 |
| 2024/0359064 | A1 * | 10/2024 | Hettinger | A63B 53/06 |

FOREIGN PATENT DOCUMENTS

| | | | | |
|---|---|---|---|---|
| GB | 2094158 | A * | 9/1982 | A63B 53/04 |
| JP | 2729760 | B2 * | 3/1998 | |
| JP | 2005058765 | A * | 3/2005 | A63B 53/047 |
| JP | 2007319687 | A * | 12/2007 | A63B 60/02 |
| JP | 2019000664 | A * | 1/2019 | A63B 53/06 |
| JP | 2019042192 | A * | 3/2019 | |
| KR | 19990076463 | A * | 10/1999 | A63B 53/0487 |
| KR | 20110033462 | A * | 3/2011 | A63B 53/047 |
| KR | 20130005384 | A * | 1/2013 | A63B 53/047 |
| KR | 101401409 | B1 * | 5/2014 | A63B 53/007 |
| KR | 20160121568 | A * | 10/2016 | A63B 53/08 |
| TW | 201538208 | A * | 10/2015 | A63B 53/0408 |
| WO | WO-0243819 | A2 * | 6/2002 | A63B 60/02 |
| WO | WO 2006018929 | | 2/2006 | |
| WO | WO-2007044220 | A1 * | 4/2007 | A63B 53/06 |
| WO | WO 2007101350 | | 9/2007 | |
| WO | WO-2015123661 | A1 * | 8/2015 | A63B 53/06 |
| WO | WO 2017205699 | | 11/2017 | |

* cited by examiner

GOLF CLUB HAVING AN ADJUSTABLE WEIGHT ASSEMBLY

CROSS-REFERENCE TO RELATED APPLICATIONS

This application is a Continuation (CON) of U.S. patent application Ser. No. 17/863,328, filed Jul. 12, 2022, the disclosure of which is incorporated by reference in its entirety.

FIELD OF THE INVENTION

The Present Invention Relates Generally to a Golf Club Head, and More Specifically, to a Golf Club Head Having an Adjustable Weight Assembly

BACKGROUND OF THE INVENTION

It is no surprise that over time golf clubs have evolved and improved. However, golf club improvements are limited by the rules of golf. Golf club bodies are subjected to volumetric limitations and golf club faces are subjected to "speed limits" based on characteristic time (CT) and coefficient of restitution (COR). Golf clubs are even subjected to limitations on "forgiveness" in terms of various moments of inertias (MOIs) measured about the center of gravity (CG) of the golf club head.

While the limitations on golf club seem substantial, there are still areas that are ripe for the picking. One such area is CG adjustability. By shaving mass from various areas of a golf club head, mass may be discretionarily concentrated in positions that afford the greatest performance benefits. Adjusting the CG location within a golf club head can result in the modification of all sorts of different aspects of the golf club. For example, adjusting the location and amount of discretionary weight within the golf club head can have a marked impact on launch angle, MOI, ball speed, spin, swing weight and the like.

Therefore, what is needed is an adjustable weight assembly that allows for discretionary mass to be adjusted in a simple and secure manner.

BRIEF SUMMARY OF THE INVENTION

In some aspects, the techniques described herein relate to a golf club head including: a striking face portion located at a frontal portion of said golf club head; and a body portion attached to the rear of said striking face portion; wherein said body portion incorporates a weight adjustment portion further including; an elongate channel further including a plurality of scalloped depressions along a lower wall of said elongate channel, a weight member having a fastener receiving aperture, and a fastener further including a fastener head and a threaded shaft, wherein said fastener head is adapted to engage at least one of said plurality of scalloped depression to secure said weight member within said elongate channel.

In some aspects, the techniques described herein relate to a golf club head including: a striking face portion located at a frontal portion of said golf club head; and a body portion attached to the rear of said striking face portion; wherein said body portion incorporates a weight adjustment portion further including; an elongate channel, a weight member having a fastener receiving aperture further including; an outer upper surface, and an inner upper surface, wherein said outer upper surface and said inner upper surface create an angle θ of between about 0° and about 45°, and a fastener.

In some aspects, the techniques described herein relate to a golf club head including: a striking face portion located at a frontal portion of said golf club head; and a body portion attached to the rear of said striking face portion; wherein said body portion incorporates a weight adjustment portion further including; an elongate channel, a weight member further including; a fastener receiving aperture, a locking edge located at a terminal end of said fastener receiving aperture, and a seating wall located adjacent to said locking edge, and a fastener further including; a fastener head having a maximum radius portion and a reduced radius portion, and a shaft having a locking portion located at a terminal end of said shaft and a groove adjacent to said locking portion, wherein said locking edge is adapted to engage said locking portion and said seating wall is adapted to engage said groove to secure said weight member within said elongate channel.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims. and scope of the invention as set forth in the following claims.

Figure 1:
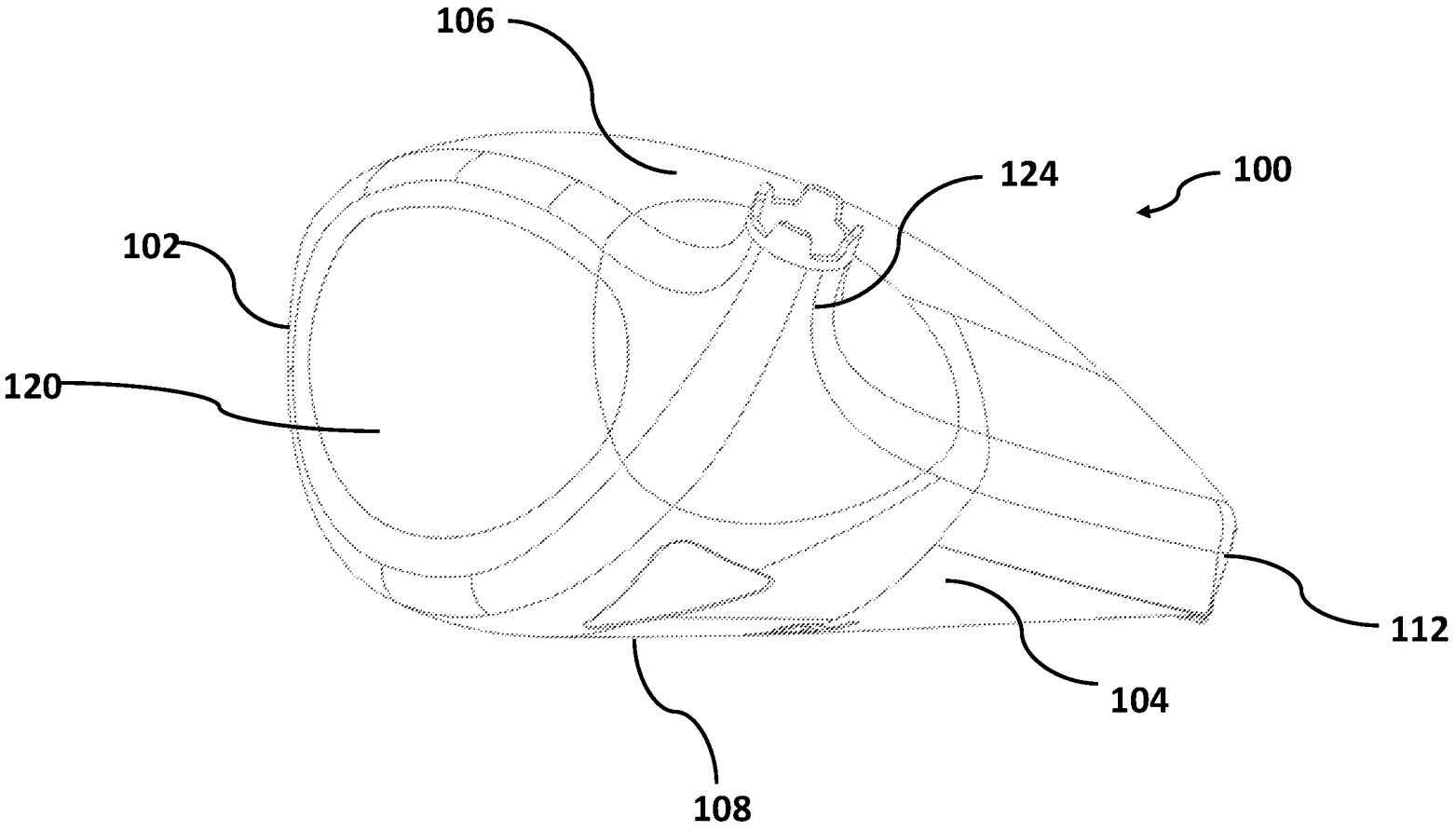
FIG. 1 of the accompanying drawings shows a frontal perspective view of a golf club head 100 in accordance with an embodiment of the present invention.

FIG. 1 of the accompanying drawings shows a frontal perspective view of a golf club head 100 in accordance with an embodiment of the present invention. In this perspective view shown in FIG. 1, the golf club head 100 may not look very different than other golf club heads, but the subsequent figures and discussion thereof will show the unique features of this golf club head 100 allow it to achieve unique performance properties consistent with the present invention. What FIG. 1 does show is a golf club head 100 having a striking face 120, a crown 106, a sole 108 opposite the crown 106, a heel 104, a toe 102 opposite the heel 104, a hosel 124 proximate the heel for coupling the golf club head 100 to a shaft (not shown), and a skirt 112 joining the crown 106 and the sole 108 and extending from the heel 104 proximate the striking face 120 to the toe 102 proximate the striking face 120. Besides the striking face 120, the combination of the crown 106, the sole 108, the heel 104, the toc 102 combine to create a body portion of a golf club head 100.

Figure 2:
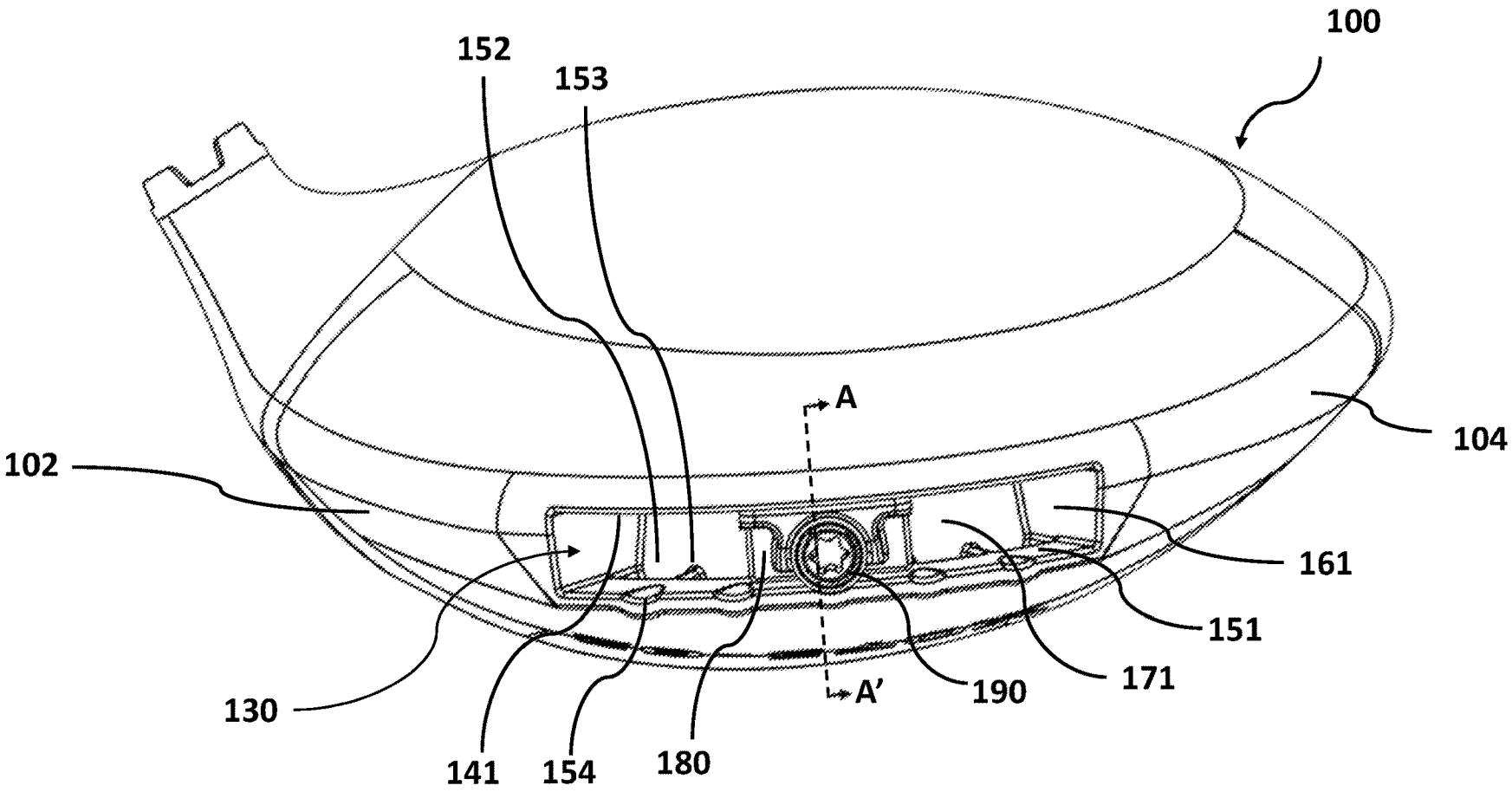
FIG. 2 of the accompanying drawings shows a rear perspective view of the golf club head 100 in accordance with an embodiment of the present invention.

FIG. 2 of the accompanying drawings shows a rear perspective view of the golf club head 100. In this perspective view, an elongate channel 130 is defined within the golf club head 100. According to the present embodiment, the elongate channel 130 is defined within the skirt 112 proximate the rear of the golf club head 100, though it is within the scope and content of the present invention for the elongate channel 130 to be formed at other positions on the golf club head 100 or even on an iron-type golf club head.

A weight member 180 is housed within the elongate channel 130, and the weight member 180 is secured at least partially by a fastener 190 as will be described below in detail. It is worth noting at this time that according to the present embodiment, the threads (not shown) of the fastener 190 mate only with the weight member 180 and not with the golf club head 100. Several additional features are shown within the elongate channel 130. Specifically, several of the surfaces that define the elongate channel 130 are illustrated in FIG. 2, though these features and more will be more clearly shown and described below. The elongate channel 130 is defined by an upper wall 141, a lower wall 151 opposite the upper wall 141, side walls 161 formed proximate the heel 104 and the toc 102, and a base wall 171 being a closest wall to the striking face 120.

The elongate channel 130 may include a plurality of lower recesses 152 defined within the lower wall 151 proximate the base wall 171. The plurality of lower recesses 152 may be separated by a plurality of ribs 153. A plurality of scalloped depressions 154 may be formed on the lower wall 151. The structure and function of these features will be more apparent when examined more closely hereinbelow.

Figure 3:
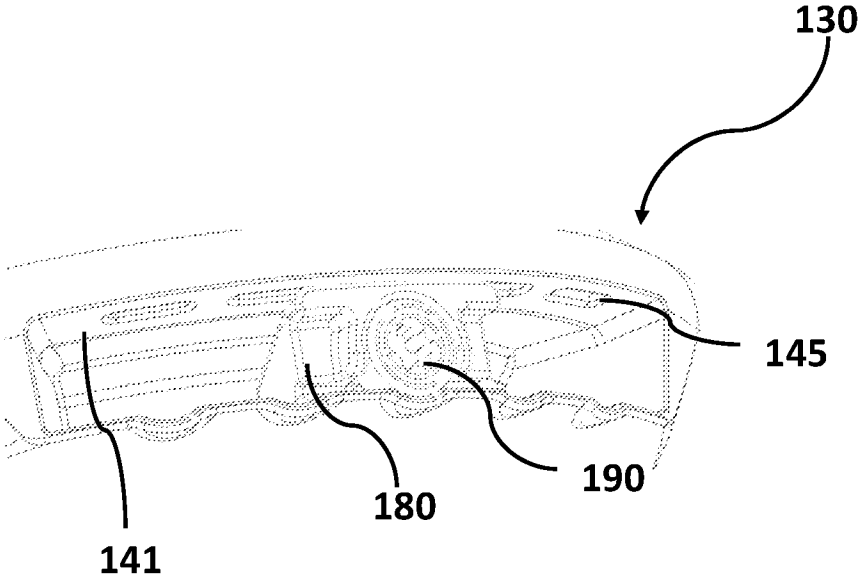
FIG. 3 of the accompanying drawings shows an enlarged perspective view of an elongate channel 130 in accordance with an embodiment of the present invention.

Referring now to FIG. 3, a perspective view of the elongate channel 130 is provided. FIG. 3 is taken from a lower perspective thus affording a clearer view of the upper wall 141. Visible from this perspective are a plurality of upper depressions 145 configured to receive a corresponding upper protrusion (see FIG. 6) formed on the weight member 180 to facilitate alignment of the weight member 180 within the elongate channel 130.

Figure 4:
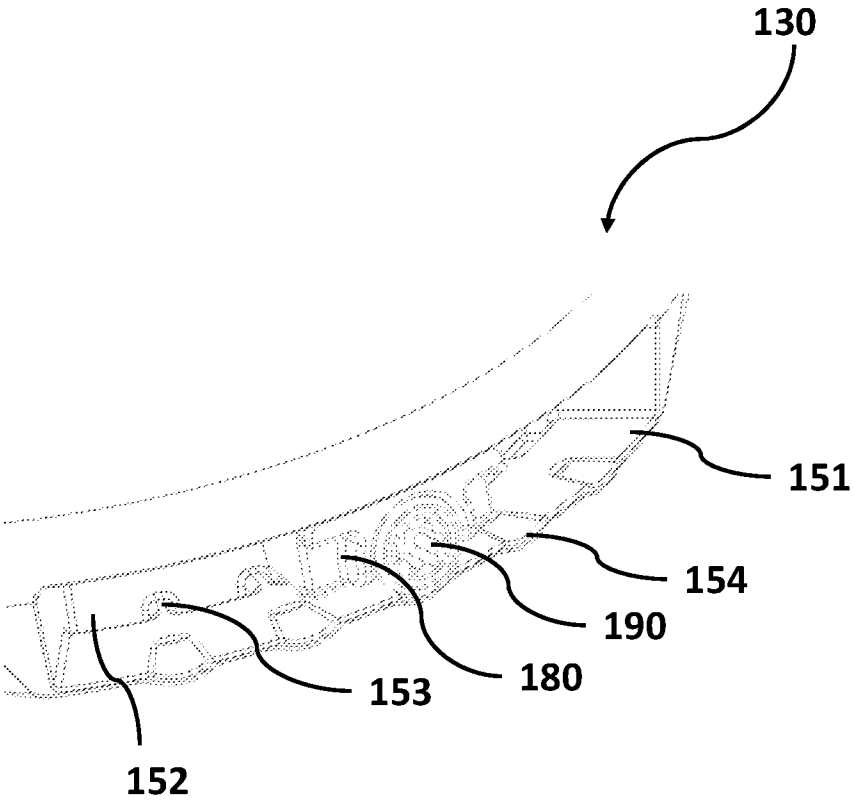
FIG. 4 of the accompanying drawings shows an alternative enlarged perspective view of an elongate channel 130 in accordance with an embodiment of the present invention.

Referring now to FIG. 4, another perspective view of the elongate channel 130 is provided. The perspective view of FIG. 4 is slightly elevated so as to better illustrate the lower wall 151. As shown in FIG. 4, each of the scalloped depressions 154 are aligned with plurality of ribs 153 in between the plurality of lower recesses 152. The scalloped depressions 154, the lower recesses 152, and the ribs 153 collectively aid in securely positioning the weight member 180 in discrete positions along the elongate channel 130. In the present embodiment, five discrete positions are defined along the elongate channel 130 and the weight member 180 is shown positioned in the middle-most position. In the present embodiment, the position of the weight member 180 is maintained by one of the scalloped depressions 154, three of the ribs 153, and one of the upper depressions 145 (sec FIG. 3).

Figure 5:
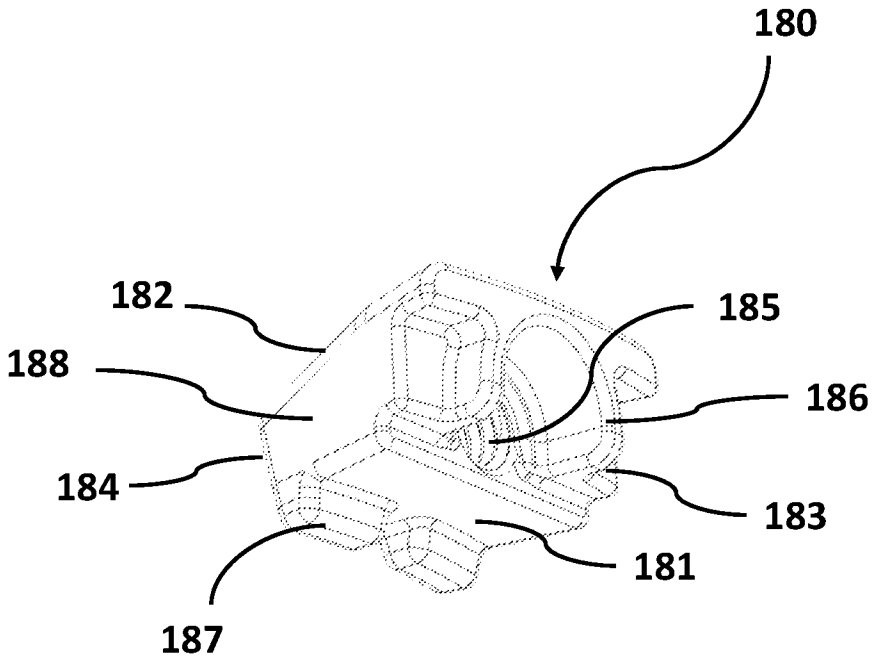
FIG. 5 of the accompanying drawings shows an enlarged perspective view of a weight member 180 in accordance with an embodiment of the present invention.

Referring now to FIG. 5, an external frontal perspective view of a weight member 180 according to an embodiment of the present invention is provided. FIG. 5 is taken from a lower perspective thus affording a clearer view of the bottom of the weight member 180. Weight member 180 includes a lower surface 181, an upper surface 182, a front surface 183, and a rear surface 184. A fastener receiving aperture 185 is defined through the front surface 183 and the rear surface 184 for receiving a fastener (not shown). A fastener receiving aperture 185 is partially surrounded by a head wall 186 proximate the front surface 183. One or more lower protrusions 187 are defined at the interface between the rear surface 184 and the lower surface 181. Upper protrusion 188 extend from the upper surface 182 to the front surface 183.

Figure 6:
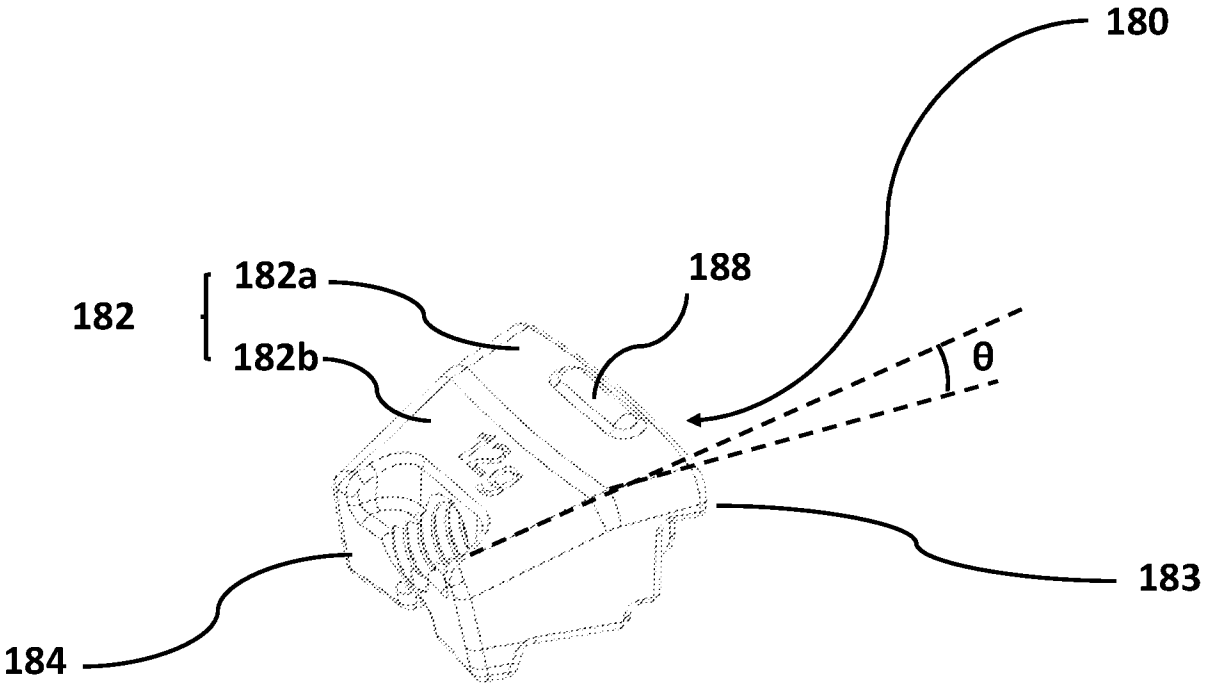
FIG. 6 of the accompanying drawings shows another enlarged perspective view of a weight member 180 in accordance with an embodiment of the present invention from a different angle.

Referring now to FIG. 6, an elevated perspective view of a weight member 180 according to another embodiment of the present invention is provided. The elevated perspective of FIG. 6 affords a clear view of the top of the weight member 180. Another unique feature that is shown in FIG. 6 is the duel faceted nature of the upper surface 182. Specifically, the upper surface 182 includes an outer upper surface **182*a* proximate the front surface 183 and an inner upper surface 182*b* proximate the rear surface 184. The outer upper surface 182*a* and the inner upper surface 182*b* define an angle θ. Preferably the angle θ is between 0° and 45°, more preferably the angle θ is between 10° and 40°, most preferably the angle θ is between about 15° and about 35°. An upper protrusion 188 is formed on the outer upper surface 182*a*. The upper protrusion 188 is dimensioned to mate with the upper depression 145 (shown in FIG. 3) to aid in securing and aligning the weight member 180 within the elongate channel 130**.

Cross-sectional views of weight member 180 shown in FIGS. 7-10 illustrate the manner in which the weight member 180 is received within the elongate channel 130. Each of FIGS. 7-10 is a cross-sectional view is taken along the line A-A' in FIG. 2. The fastener 190 is shown whole rather than sectioned to better illustrate the manner in which the weight member 180 is secured within the elongate channel 130. The line A-A' is perpendicular to the length dimension of the elongate channel 130 and offset in a heelward direction from the center of the fastener 190 so as to pass through a scalloped depression 154 and a lower recesses 152.

Figure 7:
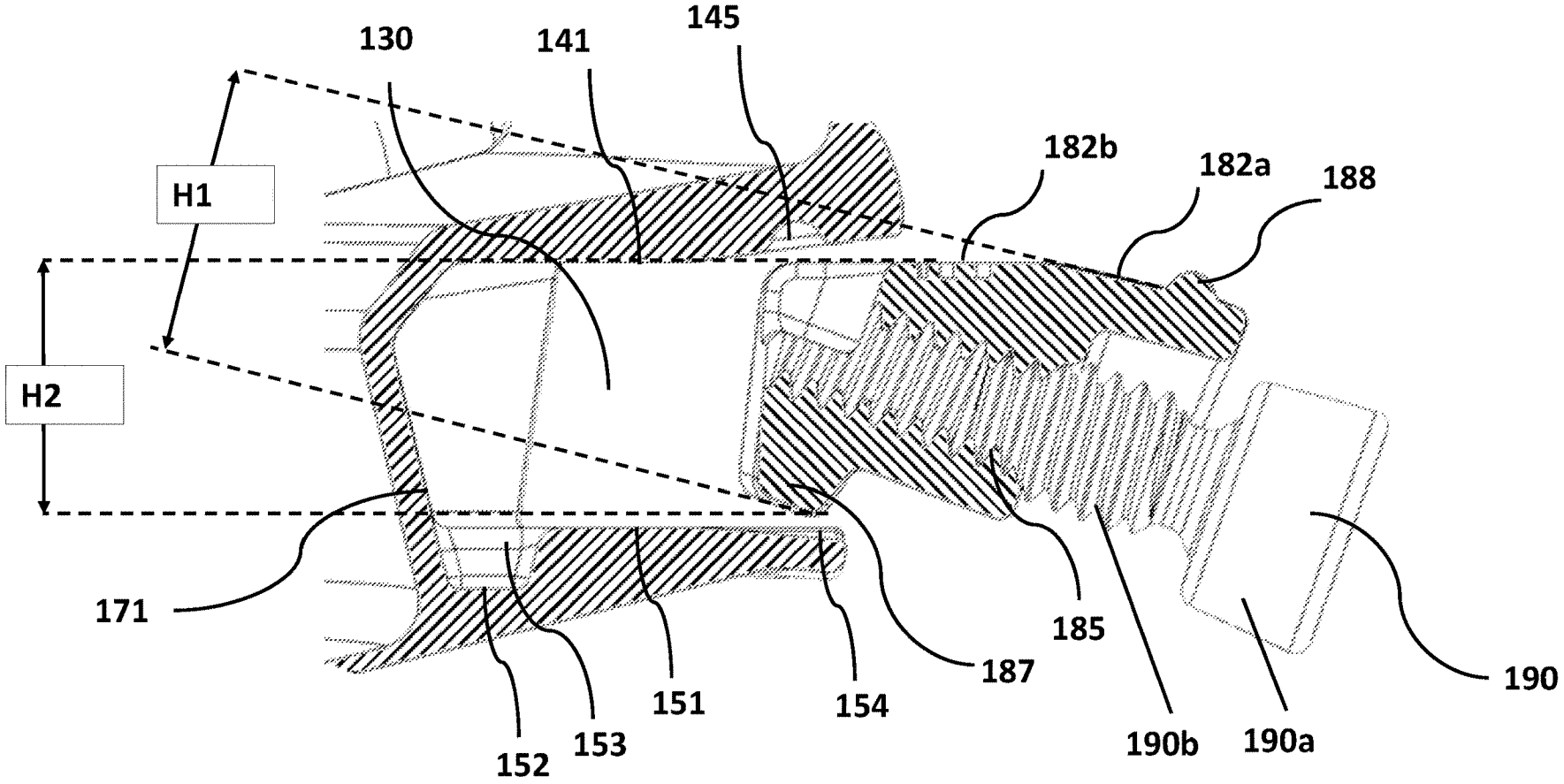
FIG. 7 of the accompanying drawings shows a cross-sectional view of the adjustable weighting assembly before insertion in accordance with an embodiment of the present invention.

Referring now to FIG. 7, prior to insertion within the elongate channel 130, the weight member 180 is angled such that that inner upper surface **182*b* is roughly parallel to the upper wall 141 and the fastener 190 is partially secured within the fastener receiving aperture 185. As shown in FIG. 7, the angled orientation of the weight member 180 allows for the one or more lower protrusions 187 to clear the lower wall 151 of the elongate channel 130. FIG. 7 also shows two identifiable heights H1 and H2 of the weight member 180, both of which work in conjunction with one another to allow the weight member 180 to be secured within the elongate channel 130. The first height H1 is measured between the outer upper surface 182*a* and the lowest portion of the lower protrusion 187, along an axis that is parallel to the fastener 190. A second height H2 is measured between the inner upper surface 182*b* and the lowest portion of the lower protrusion 187, but this time along the depth axis of the elongate channel 130, resulting in a second height H2 that is smaller than the first height H1. It is noted that that the first height H1 and the second height H2 are offset by the angle θ (shown in FIG. 6), which accounts for the rotational insertion and locking of the weight member 180 within the elongate channel 130** as described in detail below.

It is worth noting here that the fastener 190 may further be comprised of a fastener head **190*a* and a threaded shaft 190*b*, with the fastener head 190*a* adapted to engage the scalloped depressions 154 when the fastener 190** is fully engaged in a locked position.

Figure 8:
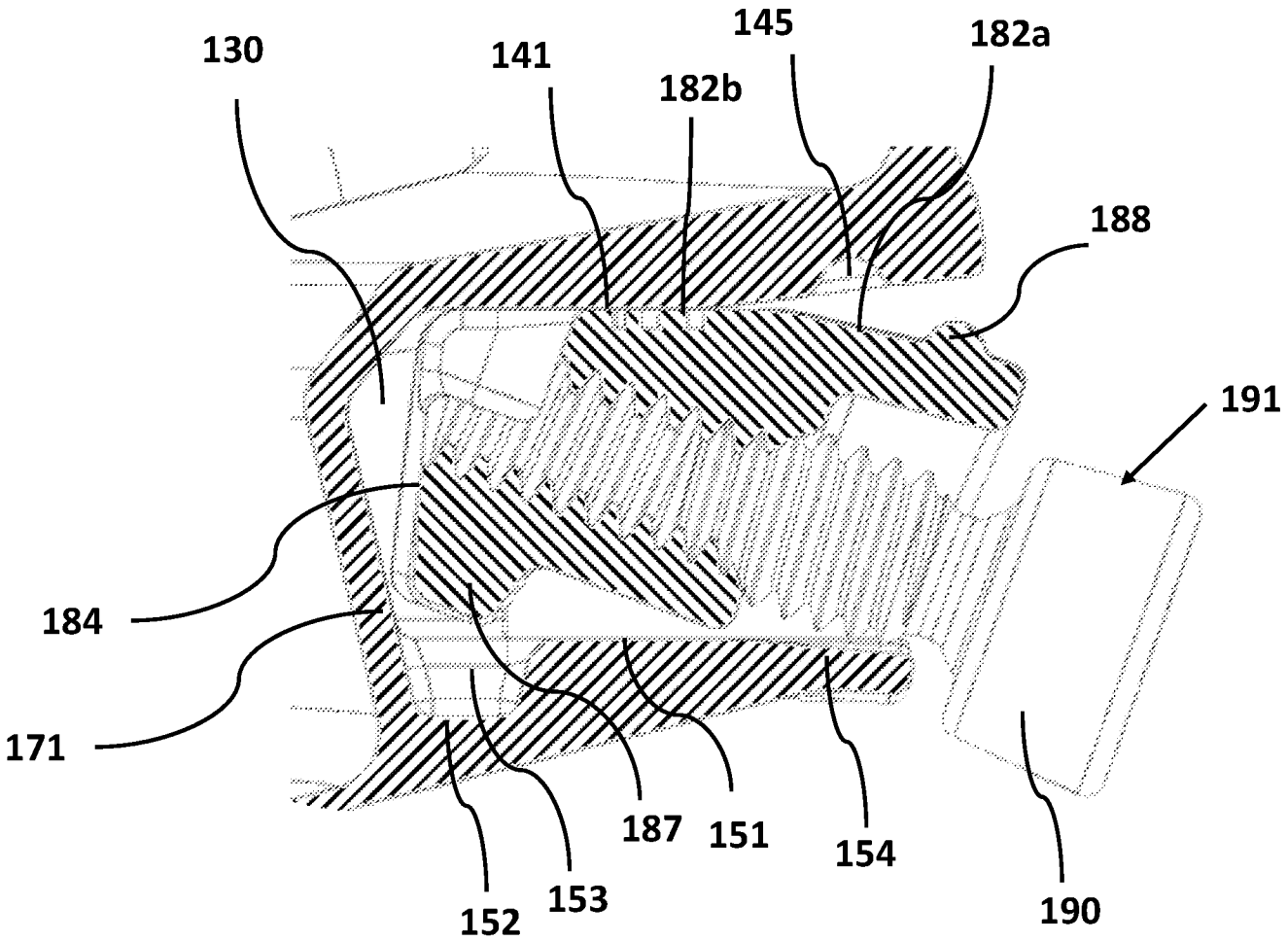
FIG. 8 of the accompanying drawings shows a cross-sectional view of the adjustable weighting assembly midway through insertion in accordance with an embodiment of the present invention.

Referring now to FIG. 8, the weight member 180 and the partially secured fastener 190 are inserted into the elongate channel 130 until the one or more lower protrusions 187 are proximate the lower recesses 152. For the purposes of this discussion, when the weight member 180 is partially inserted as shown in FIG. 8, the weight member 180 may be in an unlocked configuration. In this partially inserted unlocked configuration the weight member 180 is inserted into the elongate channel 130 and the inner upper surface **182*b* is generally parallel to the upper wall 141. In this partially inserted unlocked configuration, the weight member 180 may be freely moved along the various positions within the elongate channel 130 so that weight member 180 may be aligned with any of the discrete positions defined along the elongate channel 130**.

Figure 9:
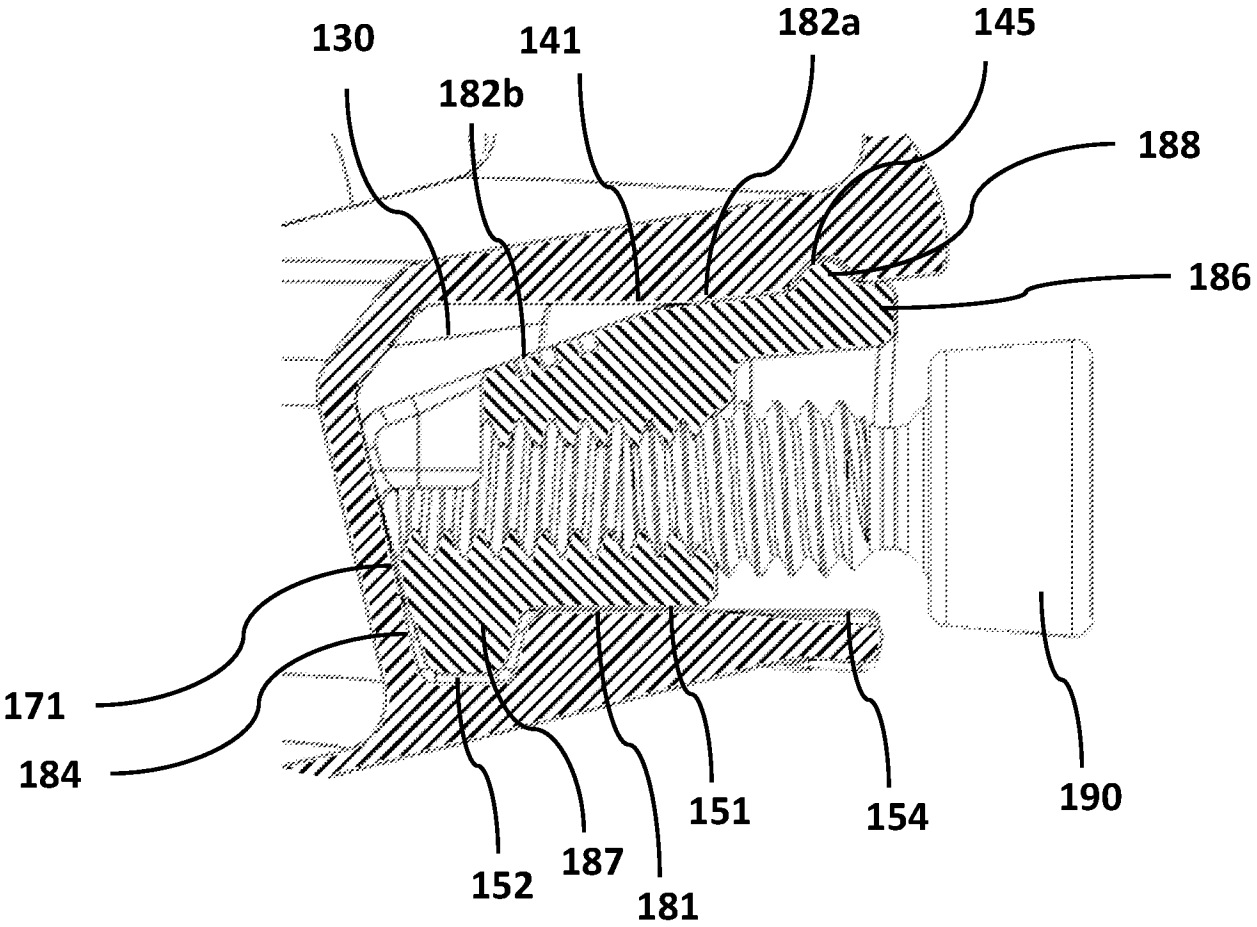
FIG. 9 of the accompanying drawings shows a cross-sectional view of the adjustable weighting assembly fully inserted but in an unlocked orientation in accordance with an embodiment of the present invention.

Referring now to FIG. 9, the weight member 180 and the partially secured fastener 190 are tilted inward until the lower protrusions 187 are engaged with one of the plurality of lower recesses 152, causing the upper protrusion 188 is received within the upper depression 145. In this rotated position, the rear surface 184 is in contact with the base wall 171, the outer upper surface 182*a* is in contact with the upper wall 141, and the lower surface 181 is in contact with the lower wall 151. Finally, from this cross-sectional view, it can be seen that the head wall 186 and the scalloped depression 154 define a cavity that is dimensioned to receive the head of the fastener 190.

Figure 10:
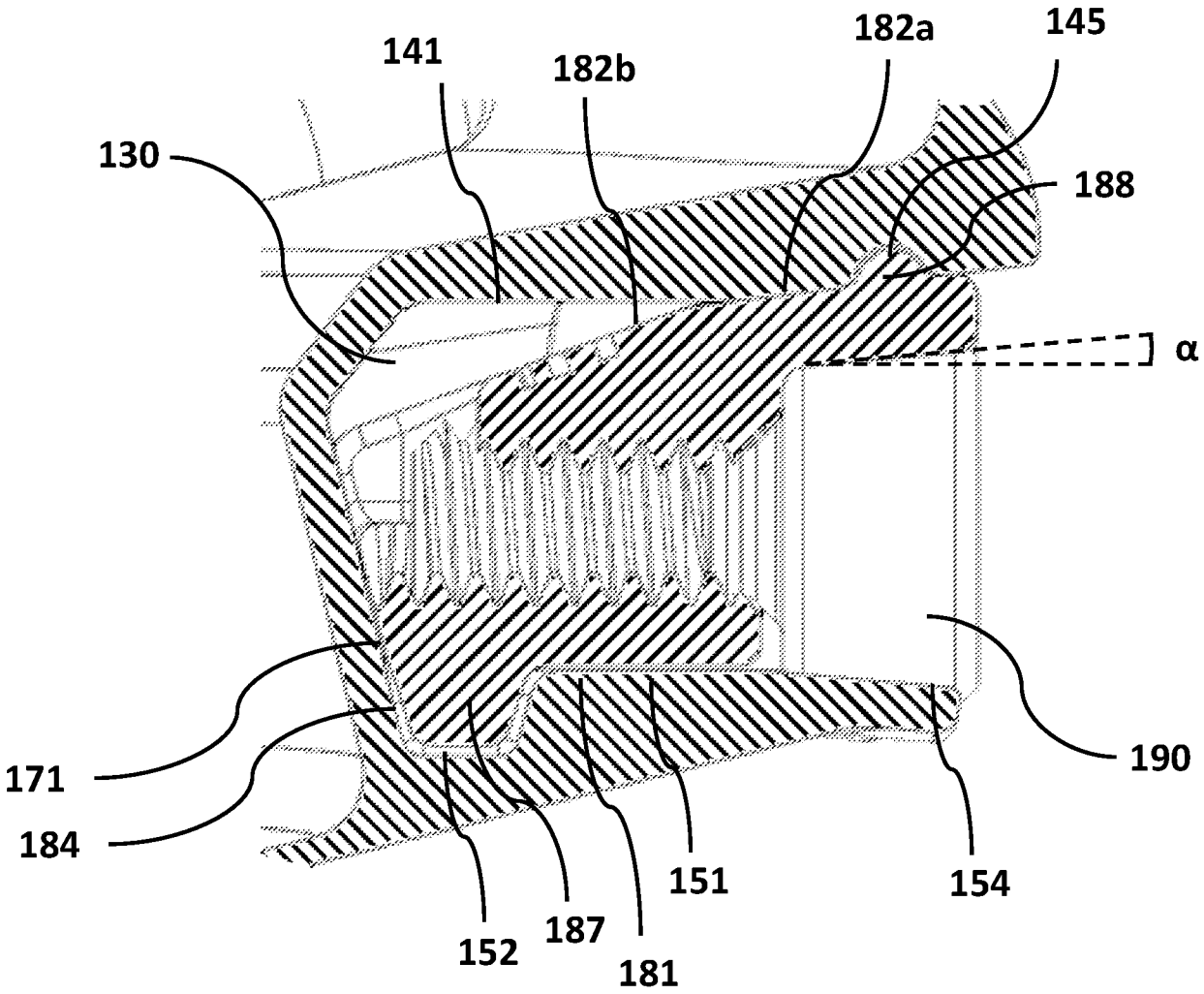
FIG. 10 of the accompanying drawings shows a cross-sectional view of the adjustable weighting assembly in a locked orientation in accordance with an embodiment of the present invention.

Referring now to FIG. 10, the fastener 190 is fully inserted to lock the weight member 180 in place. As shown in FIG. 10, the fastener 190 has a tapered head geometry to help engage the taper walls of the fastener receiving aperture 185. The taper angle α of the tapered head corresponds to a taper angle of the upper wall 141 and a taper angle of the scalloped depression 154. These corresponding taper angles are critical to locking the weight member 180 in position within the elongate channel 130. Preferably the taper angle α of the tapered head 191 is between about equal to the taper angle of the scalloped depression 154 and the taper angle θ of the upper wall 141 and about 10° greater than the taper angle of the scalloped depression 154 and the taper angle θ of the upper wall 141. As the fastener 190 is tightened, the outer upper surface 182*a* is driven toward to the upper wall 141 while the lower protrusions 187 are driven toward the lower recesses 152, thereby further rotating the weight member 180 until the one or more lower protrusions 187 are locked within the lower recesses 152 and the upper protrusion 188 is locked within the upper depression 145.

For the purposes of this discussion, when the weight member 180 and fastener 190 are inserted as shown in FIG. 10, the weight member 180 may be described as being in a locked configuration. In the locked configuration the weight member 180 is inserted into the elongate channel 130 and the outer upper surface 182*a* is generally parallel to the upper wall 141. In the locked configuration, the weight member 180 is securely fixed within the elongate channel 130.

It is worth noting at this time that it is also within the scope and content of the present invention for the weight member 180 to be inserted and rotated into position within the elongate channel 130 as shown in FIGS. 7-9 without partially inserting the fastener 190. In such a case, the fastener 190 may be inserted entirely after the weight member is inserted and rotated into position within the elongate channel 130.

Figure 11:
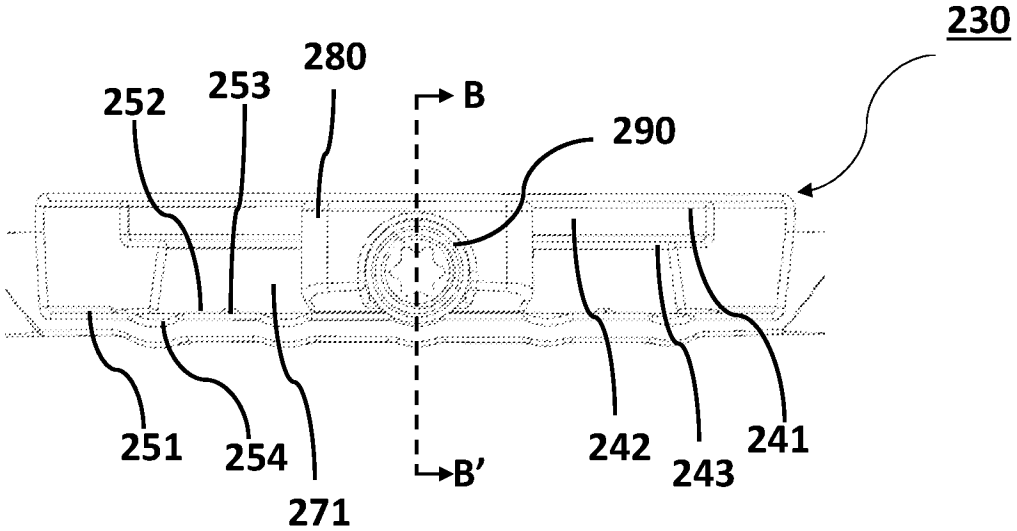
FIG. 11 of the accompanying drawings shows an enlarged perspective view of an elongate channel 230 in accordance with an alternative embodiment of the present invention.
Figure 12:
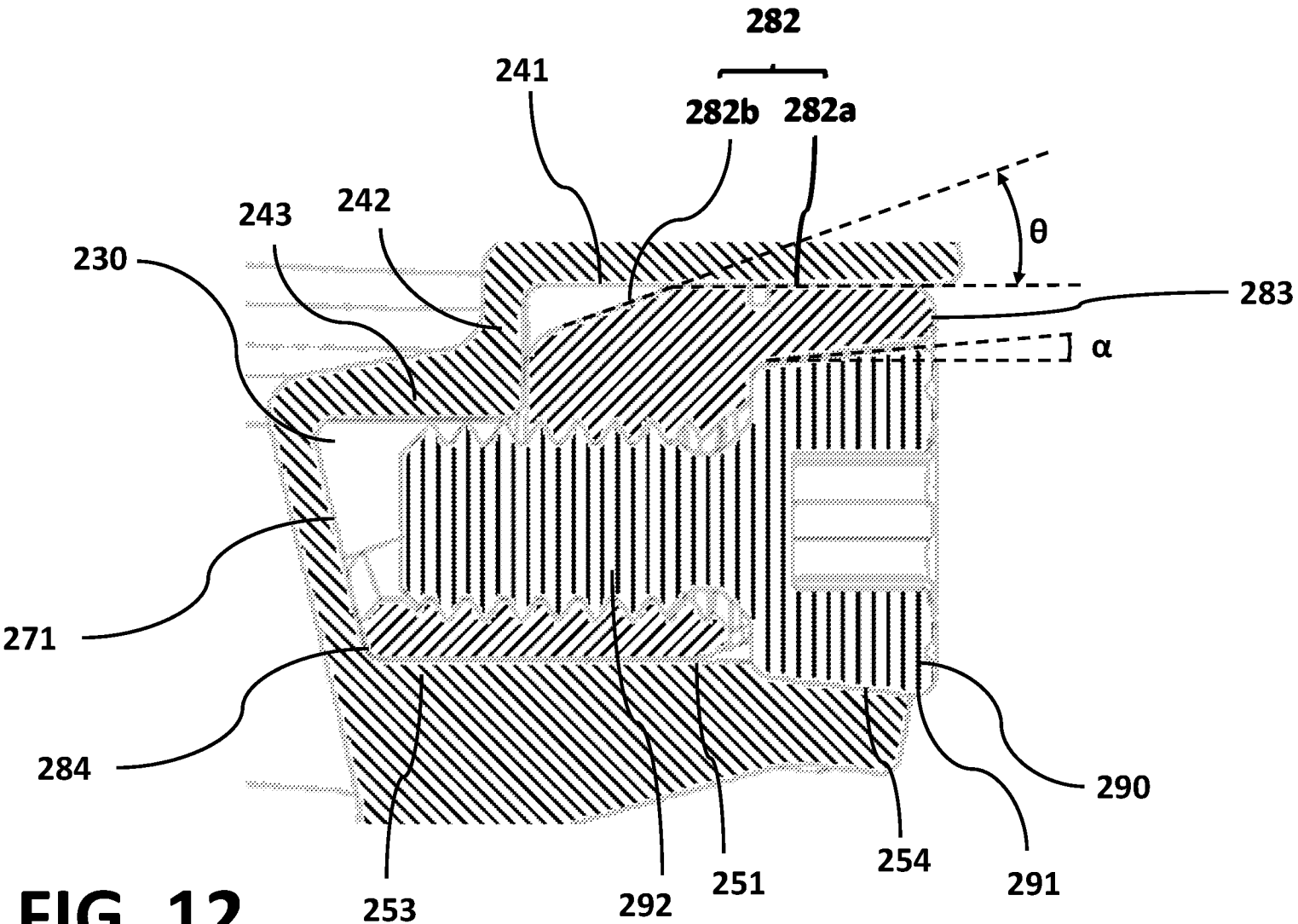
FIG. 12 of the accompanying drawings shows a cross-sectional view of an adjustable weight assembly in accordance with an alternative embodiment of the present invention.

FIGS. 11-12 show a weighting assembly in accordance with another embodiment of the present invention wherein a weight member 280 is secured within an elongate weight channel 230 by a fastener 290. The elongate weight channel 230 and the weight member 280 fundamentally function in a way very similar to those describe above in the discussion relating to FIGS. 1-10, but the current weight assembly has added risers 242 and shelfs 243. More specifically, the upper wall 241 may include a riser 242 extending down from the upper wall 241, and a shelf 243 extending from the riser 242 to the base wall 271. The lower wall 251 is substantially the same as lower wall 151, including a plurality of scalloped depressions 254 and a plurality of lower recesses 252, which may be separated by a plurality of ribs 253.

FIG. 12 shows a sectional view taken along a line B-B' in FIG. 11 passing through a center of the fastener 290. Looking first at the weight member 280, several notable features are apparent from this sectional view. Specifically, the upper surface 282 includes an outer upper surface 282*a* proximate the front surface 283 and an inner upper surface 282*b* proximate the rear surface 284. The outer upper surface 182*a* and the inner upper surface 182*b* define an angle θ. Preferably the angle θ is between 0° and 45°, more preferably the angle θ is between 10° and 40°, most preferably the angle θ is between about 15° and about 35°. The angle θ between the outer upper surface 182*a* and the inner upper surface 182*b* allows for the same rotation based insertion technique illustrated above in FIGS. 7-10. It is noted that the weight member 280 includes lower protrusions, though the lower protrusions are not visible through the rib 253 from this sectional view.

The orientation of the riser 242 and the shelf 243 are shown much more clearly in FIG. 12. According to an embodiment of the present invention, the riser 242 may extend downward from the upper wall 241 and the shelf 243 extends rearward from the riser 242 so as to join the upper wall 241 and the base wall 271. The riser 242 and the shelf 243 afford further contact surfaces for securing the weight member 280 within the elongate channel 230. The shaft 292 of the fastener 290 contacts the shelf 243 and the upper portion of the rear surface 284 of the weight member 280 contacts the riser 242 when the weight member is locked within the elongate weight channel 230. These additional points of contact between the weight member 280 and the elongate channel 230 thus further ensuring a secure fit between the weight member 280 and the elongate channel 230.

When fully seated and secured within the elongate channel 230, the weight member 280 and the fastener 290 contact numerous portions of the elongate channel 230. When the weight member 280 is rotated into the elongate channel 230 such that the lower protrusions (not shown) are received within the lower recesses (not shown), the fastener 290 is tightened to secure the weight member 280 within the elongate channel 230. As shown in FIG. 12, the rear surface 284 contacts not only the rear wall 271, but also the riser 242. When the weight member 280 is fully seated and secured within the elongate channel 230, the lower portion of the rear surface 284 may contact the rear wall 271 and the rear surface 284 may contact the riser 242. Further, when the weight member 280 is fully seated and secured within the elongate channel 230, the shaft 292 of the fastener 290 may contact the shelf 243. Finally, as described above, when the weight member 280 is fully seated and secured within the elongate channel 230, the head 291 of the fastener 290 is contacted by the scalloped shape depression 254 which drives the outer upper surface 282*a* toward the upper wall 241, further locking the weight member 280 in place. While the present embodiment does not include an upper protrusion or a corresponding upper depression, their inclusion is within the scope and content of the present invention.

Figure 13:
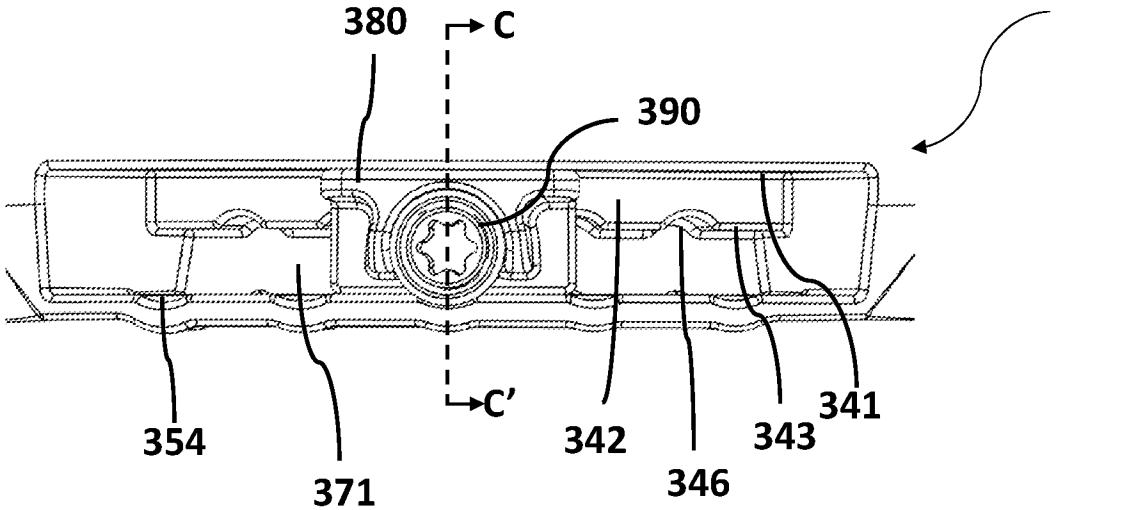
FIG. 13 of the accompanying drawings shows an enlarged perspective view of an elongate channel 330 in accordance with an alternative embodiment of the present invention.
Figure 14:
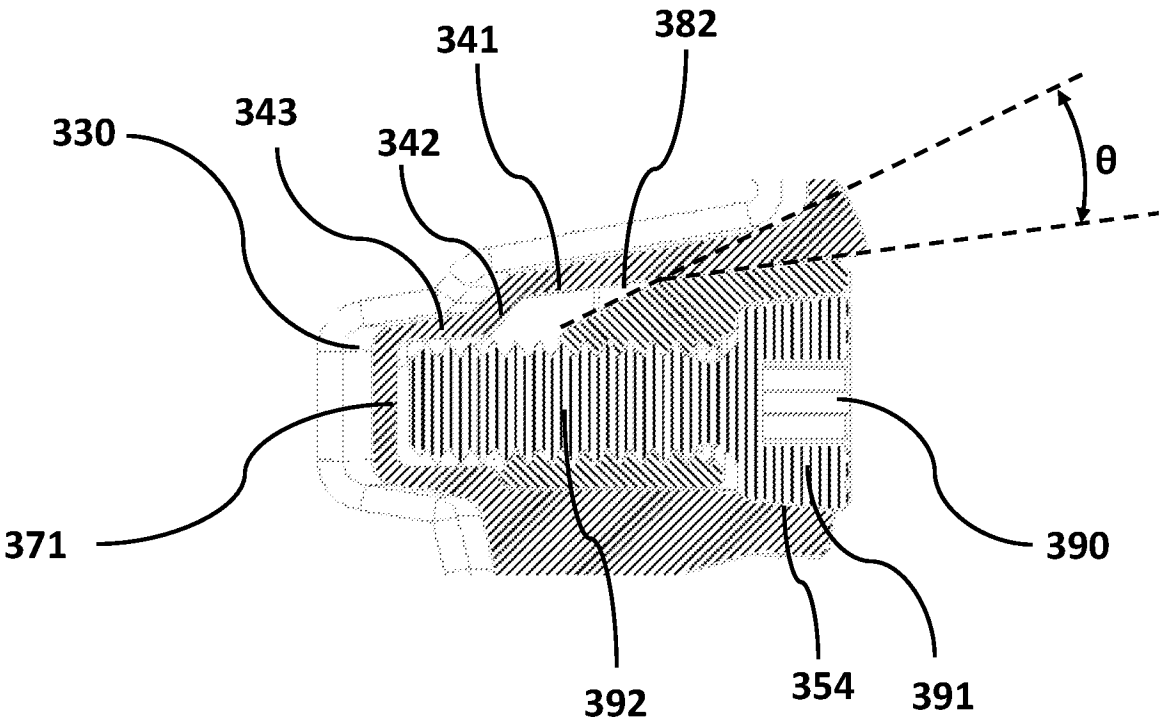
FIG. 14 of the accompanying drawings shows a cross-sectional view of an adjustable weight assembly in accordance with an alternative embodiment of the present invention.

FIGS. 13 and 14 of the accompanying drawings shows a rear view and cross-sectional view of a weight member 380 in accordance with a further alternative embodiment of the present invention.

FIG. 13 shows an enhanced rear view of the elongate channel 330 wherein the elongate channel 330 is similar to those described above but includes a further modified upper wall 341. In detail, the upper wall 341 may include a riser 342 extending down from the upper wall 341, and a shelf 343 extending from the riser 342 to the base wall 371.

FIG. 14 shows a sectional view taken along a line C-C' in FIG. 13 passing through a center of the fastener 390. From this perspective the riser 342 and the shelf 343 joining the upper wall 341 and the base wall 371 are clearly illustrated. While the structure of the elongate channel 330 is similar to the elongate channel 230, two notable differences are apparent from this sectional view. First, the shaft 392 of the fastener 390 contacts a cutout 346 defined on the shelf 343 when the weight member is locked within the elongate channel 330. This additional point of contact between the weight member 380 and the elongate channel 330 thus further ensuring a secure fit between the weight member 380 and the elongate channel 330. Second, the upper rear surface 382 does not contact the riser 342. While it is within the scope and content of the present invention for the upper rear surface 382 and the riser 342 to contact each other when the weight member 380 is fully inserted and secured within the elongate channel 330, the weight member 380 may be sufficiently secured within the elongate channel 330 even without this additional point of contact.

The plurality of cutouts 346 correspond to discrete seating locations of the weight member 380. According to an embodiment of the present invention, although not aligned linearly, each of the plurality of cutouts 346 corresponds with one of the plurality of scalloped depressions 354 such that for any given position the head 391 of the fastener 390 contacts a scalloped depression 354 and the shaft 392 of the fastener 390 contacts the corresponding cutout 346. In other words, the elongate channel 330 differs from elongate channel 230 in that a plurality of cutouts 346 are defined in the riser 342 and the shelf 343, and the shelf 343 and the riser 342 are dimensioned such that the riser 342 does not contact the weight member 380 when the weight member 380 is fully inserted and secured within the elongate channel 330. The cutouts 346 offer an additional means of aligning a weight member within the elongate channel 330 and also offer additional support in preventing the weight member from moving within the elongate channel 330 during impact with a golf ball.

FIGS. 15-22 show a weight member 480 and a fastener 490 according to yet another embodiment of the present invention. The weight member 480 is similar to the above weight members with a few notable differences. In fact, with the exception of the fastener receiving hole 485 and a corresponding fastener 490, the weight member 480 may be dimensioned to fit within any of the elongate channels described above.

Figure 15:
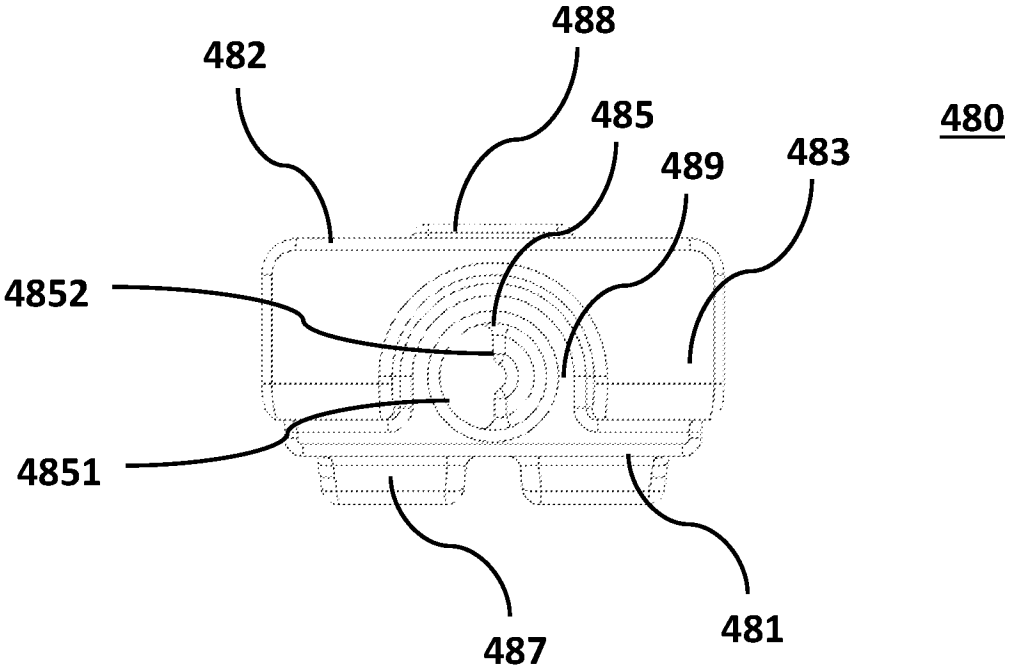
FIG. 15 of the accompanying drawings shows a rear view of a weight member 480 in accordance with an alternative embodiment of the present invention.
Figure 16:
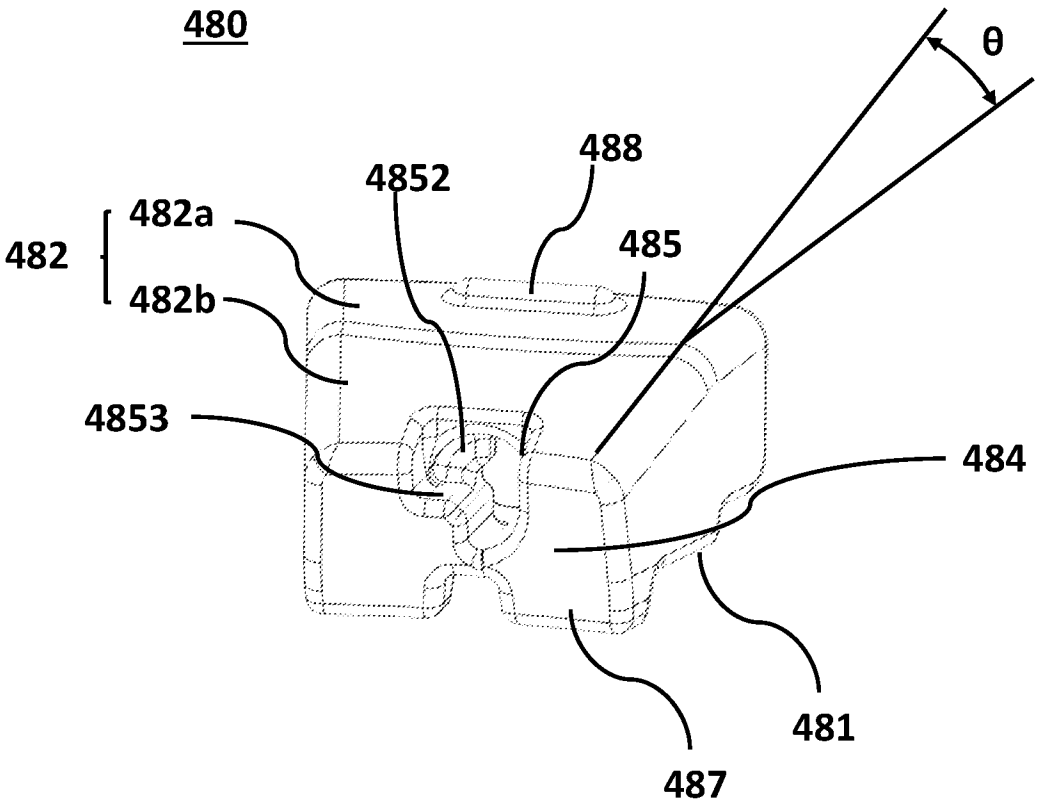
FIG. 16 of the accompanying drawings shows a perspective view of a weight member 480 in accordance with an alternative embodiment of the present invention.

Referring to FIGS. 15 and 16, a frontal and rear view of weight member 480 is provided. The weight member 480 includes a lower surface 481, an upper surface 482, a front surface 483, and a rear surface 484. A fastener receiving hole 485 is defined through the front surface 483 and the rear surface 484 for receiving a fastener (not shown). A first abutment surface 489 is located around a periphery of the fastener receiving hole 485, partially recessed from the front surface 483. One or more lower protrusions 487 are defined at the interface between the rear surface 484 and the lower surface 481. The fastener receiving hole 485 is neither threaded nor cylindrical, but rather is keyed so as to receive a keyed fastener therein as described below. The sectional shape of the fastener receiving hole 485 is variable along a depth direction from the front surface 483 toward the rear surface 484. From this perspective, the front portion 4851 of the fastener receiving hole 485 is visible. The front portion 4851 is generally cylindrical in shape and functions to align the fastener within the fastener receiving hole 485. Moving inward from the front portion 4851, the fastener receiving hole 485 includes a seating wall 4852 that extends a partial width of the fastener receiving hole 485 and sets a maximum insertion depth for the fastener. While the seating wall 4852 is situated toward the right or toe-side of the fastener receiving hole 485, the present invention is not limited in this regard. It is within the scope and content of the present invention for the seating wall 4852 to be positioned anywhere within the fastener receiving hole 485 so long as the seating wall 4852 only extends a partial width of the fastener receiving hole 485.

Referring now to FIG. 16, a rear perspective view of the weight member 480 sheds additional light on the structure of the weight member 480, specifically that of the fastener receiving hole 485. From this perspective, the rear of the seating wall 4852 is visible. Moving inward (toward the rear surface 484) from the seating wall 4852, the fastener receiving hole 485 includes a locking ledge 4853. The locking ledge 4853 is located behind the seating wall 4852 in the depth direction from the front surface 483 toward the rear surface 484. The locking ledge 4853 between the uppermost and lowermost extents of the fastener receiving hole 485. Alternatively, it can be said that a height of the locking ledge 4853 measured in an upper surface 481 lower surface 482 direction is less than a diameter of the fastener receiving hole 485.

The elevated perspective of FIG. 16 affords a clear view of the dual faceted nature of the upper surface 482. Specifically, the upper surface 482 includes an outer upper surface 482*a* proximate the front surface 483 and an inner upper surface 482*b* proximate the rear surface 484. The outer upper surface 482*a* and the inner upper surface 482*b* define an angle θ. Preferably the angle θ is between 0° and 45°, more preferably the angle θ is between 10° and 40°, most preferably the angle θ is between about 15° and about 35°. An upper protrusion 488 is formed on the outer upper surface 482*a*.

Figure 17:
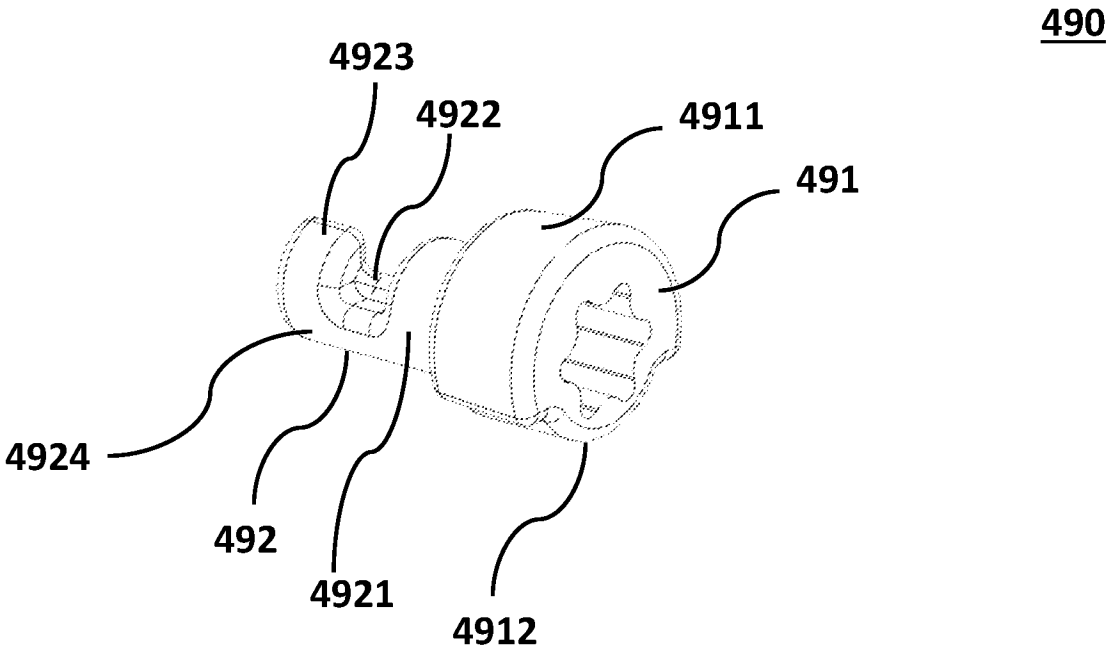
FIG. 17 of the accompanying drawings shows a perspective view of a fastener 490 in accordance with an alternative embodiment of the present invention.
Figure 18:
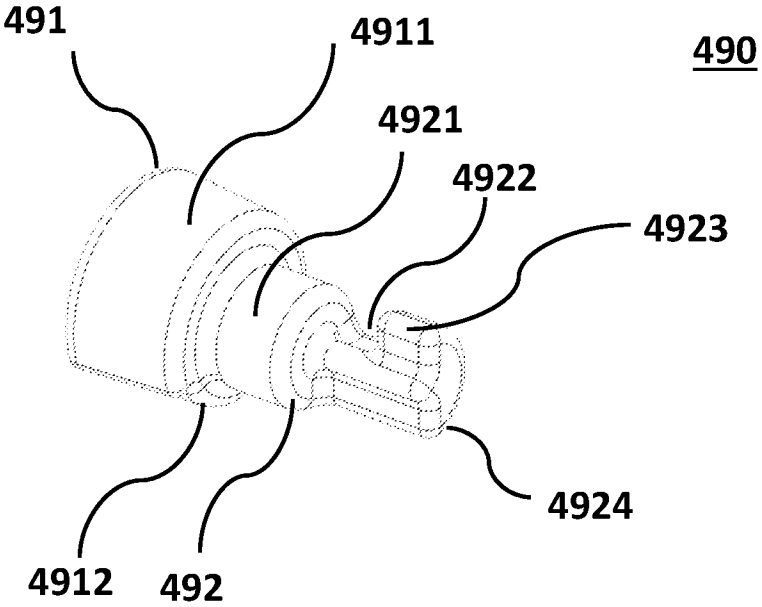
FIG. 18 of the accompanying drawings shows a perspective view of a fastener 490 from a different angle in accordance with an alternative embodiment of the present invention.

Referring now to FIGS. 17 and 18, two perspective views of the fastener 490 that begin to show how the fastener 490 functions to lock the weight member 480 within an elongate channel. The fastener 490 and the fastener receiving hole 485 are designed to lock the weight member 480 within the elongate channel 430 with only a quarter of a turn (90° rotation) of the fastener 490.

FIG. 17 is a frontal overhead perspective view of the fastener 490. As shown in FIG. 17, the fastener 490 includes a head 491 and a shaft 492. The head 491 has a cam surface including a maximum radius portion 4911 and a reduced radius portion 4912 having a radius less than that of the maximum radius portion 4911. The shaft 492 includes an alignment portion 4921, a groove 4922, a locking portion 4923, and an abutment surface 4924.

FIG. 18 shows a rear overhead perspective view of the fastener 490. FIG. 18 shows the same features as FIG. 17, but more clearly shows how the key-like structure of the fastener 490. Specifically, from this perspective it is easy to see how the shaft 492 is generally cylindrical and how the groove 4922 and the locking portion 4923 are essentially carved from the generally cylindric shape shaft 492.

Figure 19:
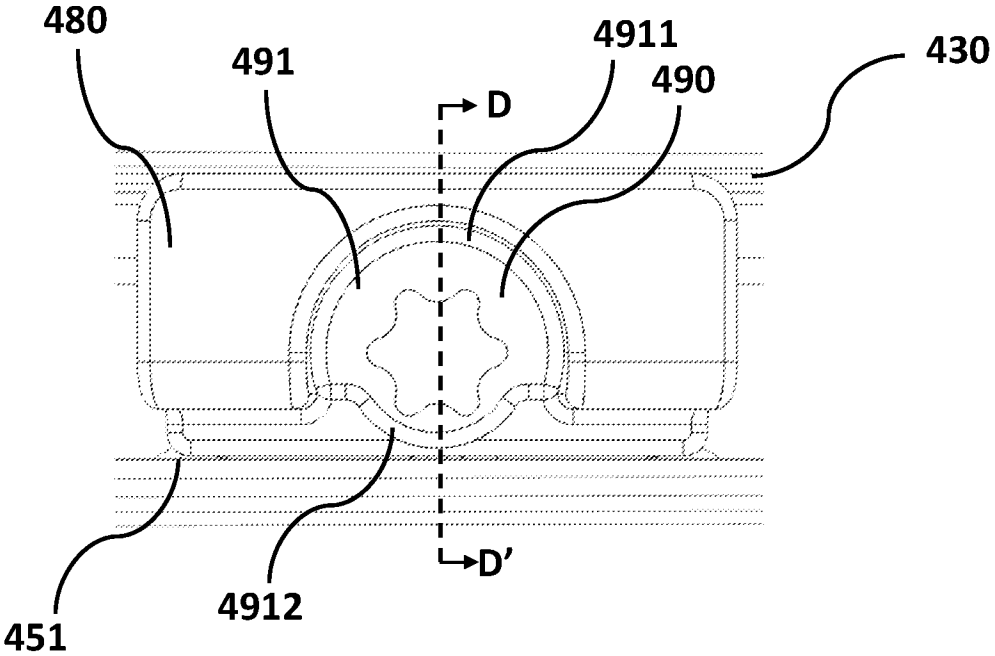
FIG. 19 of the accompanying drawings shows a rear view of an adjustable weight assembly in an unlocked orientation in accordance with an alternative embodiment of the present invention.
Figure 20:
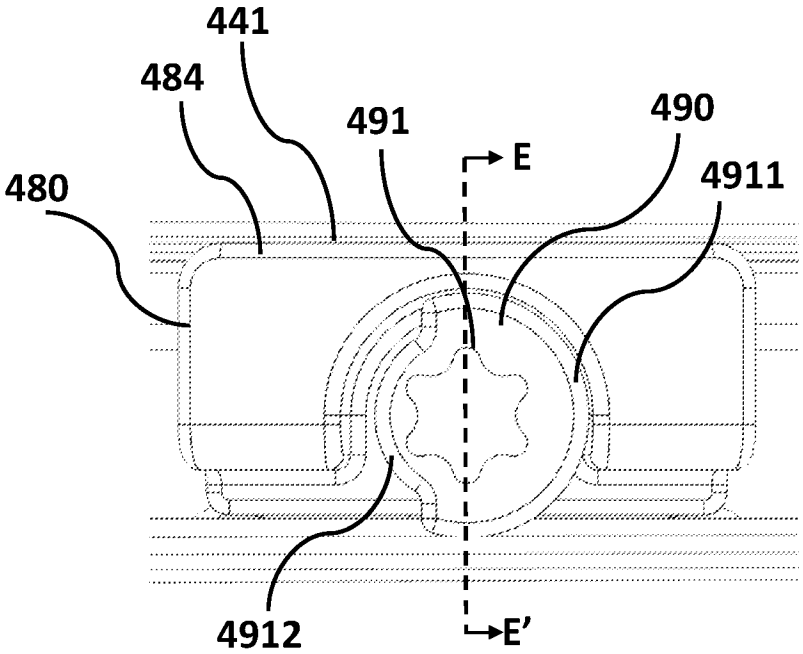
FIG. 20 of the accompanying drawings shows a rear view of an adjustable weight assembly in a partially locked orientation in accordance with an alternative embodiment of the present invention.

FIGS. 19-20 show the weight member 480 positioned within an elongate channel 430 in an unlocked configuration and a locked configuration.

Referring now to FIG. 19, a frontal view of the weight member 480 is shown within the elongate channel 430 in an unlocked configuration. In the unlocked configuration, the weight member 480 may be freely moved between each of the discrete weight locations. From this perspective, it is clear the role that the head 491 plays when the weight member 480 is in the unlocked configuration. As shown in FIG. 19, in the unlocked configuration, the maximum radius portion 4911 is positioned away from the lower wall 451 of the elongate channel 430 and the reduced radius portion 4912 is positioned proximate the lower wall 451.

Referring now to FIG. 20, a frontal view of the weight member 480 is shown within the elongate channel 430 in the partially locked configuration. In the partially locked configuration, the fastener 490 is rotated 90° relative to its position in the unlocked configuration and the weight member 480 is securely fastened within one of the discrete weight locations defined by the positions of the lower recesses (not shown). From this perspective, it is clear the role that the head 491 plays in transitioning from the unlocked configuration to the partially locked configuration. As shown in FIG. 20, in the partially locked configuration, the maximum radius portion 4911 no engages the lower wall 451 while the reduced radius portion 4912 is positioned away from the lower wall 451. By rotating the fastener 490 such that the maximum radius portion 4911 of the fastener 490 contacts the lower wall 451, the upper surface 484 of the weight member 480 is driven up toward the upper wall 441 of the elongate channel 430 thus locking the weight member 480 in place.

Figure 21:
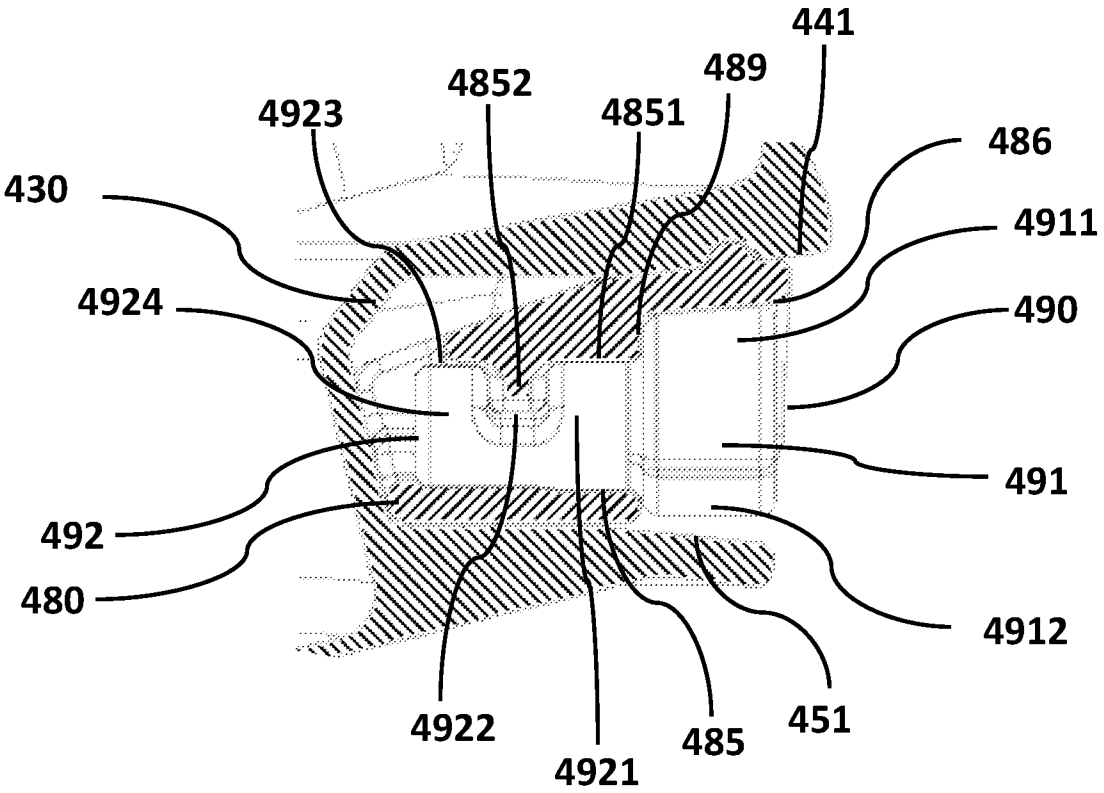
FIG. 21 of the accompanying drawings shows a cross-sectional view of an adjustable weight assembly in an unlocked orientation in accordance with an alternative embodiment of the present invention.
Figure 22:
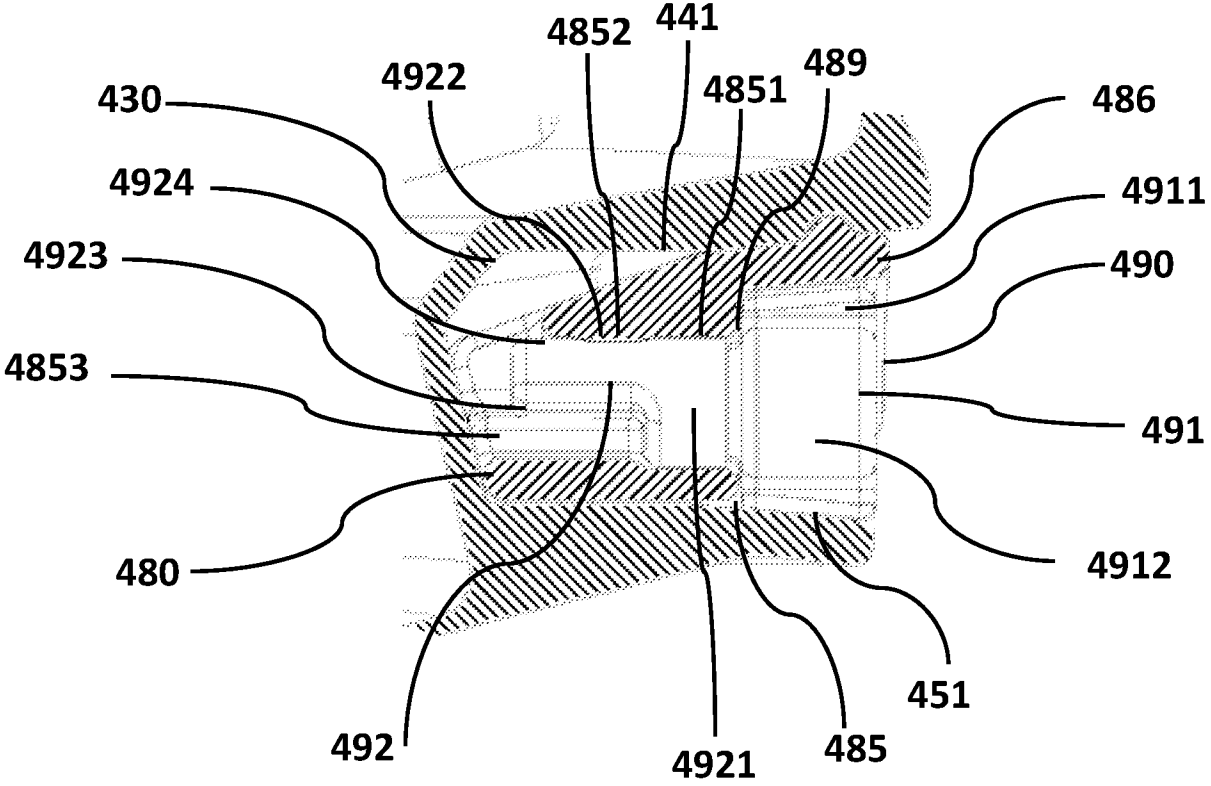
FIG. 22 of the accompanying drawings shows a cross-sectional view of an adjustable weight assembly in a locked orientation in accordance with an alternative embodiment of the present invention.

FIGS. 21 and 22 show sectional views of the weight member 480 positioned within the elongate channel 430 in the unlocked and locked configurations.

Referring to FIG. 21, a sectional view taken along the sectional line D-D' of FIG. 19 of the weight member 480 in an unlocked configuration is provided. It is noted that the fastener is shown whole rather than in section for clarity. From this perspective, the asymmetry and lock and key like nature of the fastener 490 and the fastener receiving hole 485 are on full display.

As shown in FIG. 21, the fastener 490 is fully inserted within the fastener receiving hole 485 such that the head 491 is abutting the first abutment surface 489 and the alignment portion 4921 is fitted within the generally cylindrical front portion 4851 and abutting the seating wall 4852.

The head 491 of the fastener 490 is surrounded on the top and sides by the head wall 486 and on the bottom by the lower wall 451. The maximum radius portion 4911 of the head 491 is in contact with the head wall 486 and the reduced radius portion 4912 of the head 491 is spaced apart from the lower wall 451.

The seating wall 4852 of the shaft 492 is positioned proximate the seating wall 4852 and the locking portion 4923 is positioned proximate the locking ledge (not shown). The abutment surface 4924 is positioned proximate a side surface of the fastener receiving hole 485.

As described above, in this configuration the fastener 490 may be freely inserted and removed from the fastener receiving hole 485 and the weight member 480 may be removed from the elongate channel 430 or adjusted within the elongate channel 430.

As shown in FIG. 22, the fastener 490 has been rotated 90° in a clockwise direction and is now in the locked configuration. The head 491 of the fastener 490 is surrounded on the top and sides by the head wall 486 and on the bottom by the lower wall 451.

In transitioning from the unlocked configuration to the locked configuration, the fastener 490 has not moved in a longitudinal direction as the alignment portion 4921 remains centered within the frontal portion 4851.

However, by rotating the fastener 490 into the locked configuration, several key features are now apparent. First of all, the maximum radius portion 4911 of the head 491 is now in contact with both the lower wall 451 and the head wall 486. This drives the weight member 480 up so as to contact the upper wall 441 and prevents vertical movement of the weight member 480. Similarly the groove 4922 now surrounds the seating wall 4852 which prevents longitudinal translation of the fastener 490 within the fastener receiving hole 485. The locking portion 4923 is also driven into contact the locking ledge 4853, which prevents the fastener 490 from moving vertically within the fastener receiving hole 485.

FIGS. 23 through 28 show a weight member 580 and a fastener 590 according to yet another embodiment of the present invention.

Figure 23:
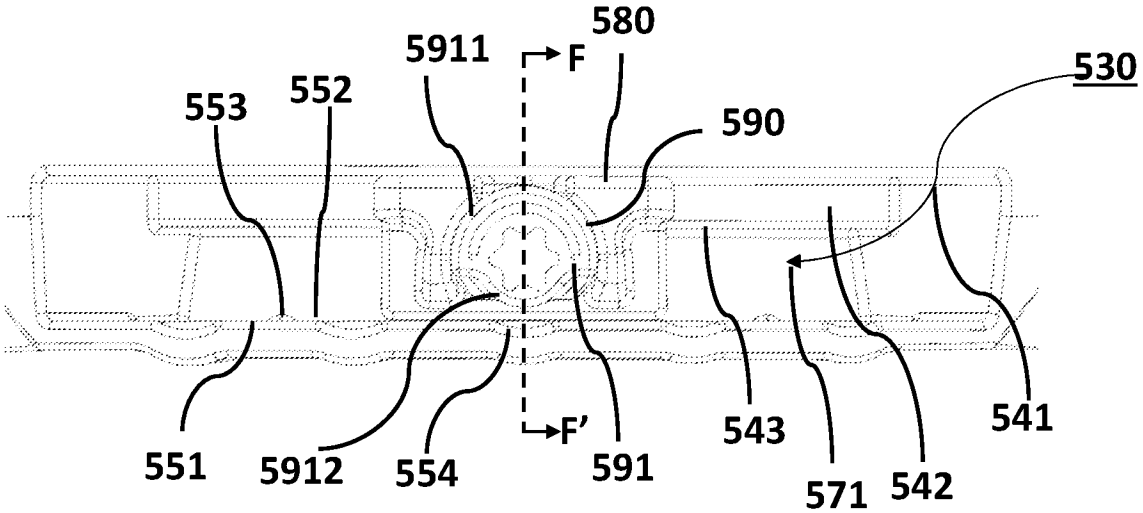
FIG. 23 of the accompanying drawings shows a rear view of an adjustable weight assembly in an unlocked orientation in accordance with a further alternative embodiment of the present invention.

Referring to FIG. 23, an enhanced view of an elongate channel 530 is provided. A weight member 580 is positioned within the elongate channel 530 and a fastener 590 is in an unlocked configuration. In this configuration the weight member 580 may be moved along a length of the elongate channel 530. The elongate channel 530 includes an upper wall 541 having a riser 542 extending down from the upper wall 541 and a shelf 543 extending from the riser 542 to the base wall 571. The lower wall 551 includes a plurality of scalloped depressions 554 and a plurality of lower recesses 552, which may be separated by a plurality of ribs 553.

Fastener 590 is similar to fastener 490. Fastener 590 includes a fastener head 591 having a maximum radius portion 5911 and a reduced radius portion 5912 having a radius less than that of the maximum radius portion 5911. Fastener 590 also may be transitioned from an unlocked state to a locked state with only a half of a turn (180°).

Figure 24:
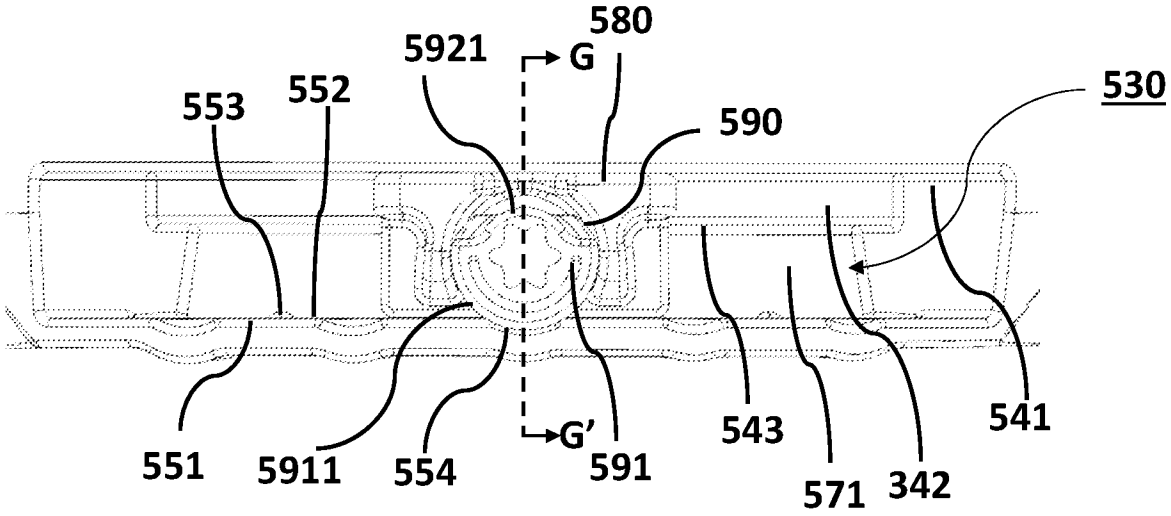
FIG. 24 of the accompanying drawings shows a rear view of an adjustable weight assembly in a locked orientation in accordance with a further alternative embodiment of the present invention.

FIG. 24 shows the weight member 580 in a locked configuration with the fastener 590 rotated a half turn (180°) relative to FIG. 23. From this perspective, the only differences between the locked and unlocked configuration is the relative positioning of the fastener 590, though additional features will be apparent upon closer examination. Notably from this perspective is that the maximum radius portion 5911 of the head 591 is proximate one of the scalloped depressions 554. As described above in detail, when the maximum radius portion 5911 contacts the scalloped depression 554 is drives the weight member 580 into the upper wall 541, thus locking the weight member 580 in place.

FIGS. 25-28 show various sectional views that further detail the interaction of the fastener 590, the weight member 580, and the elongate channel 530.

Figure 25:
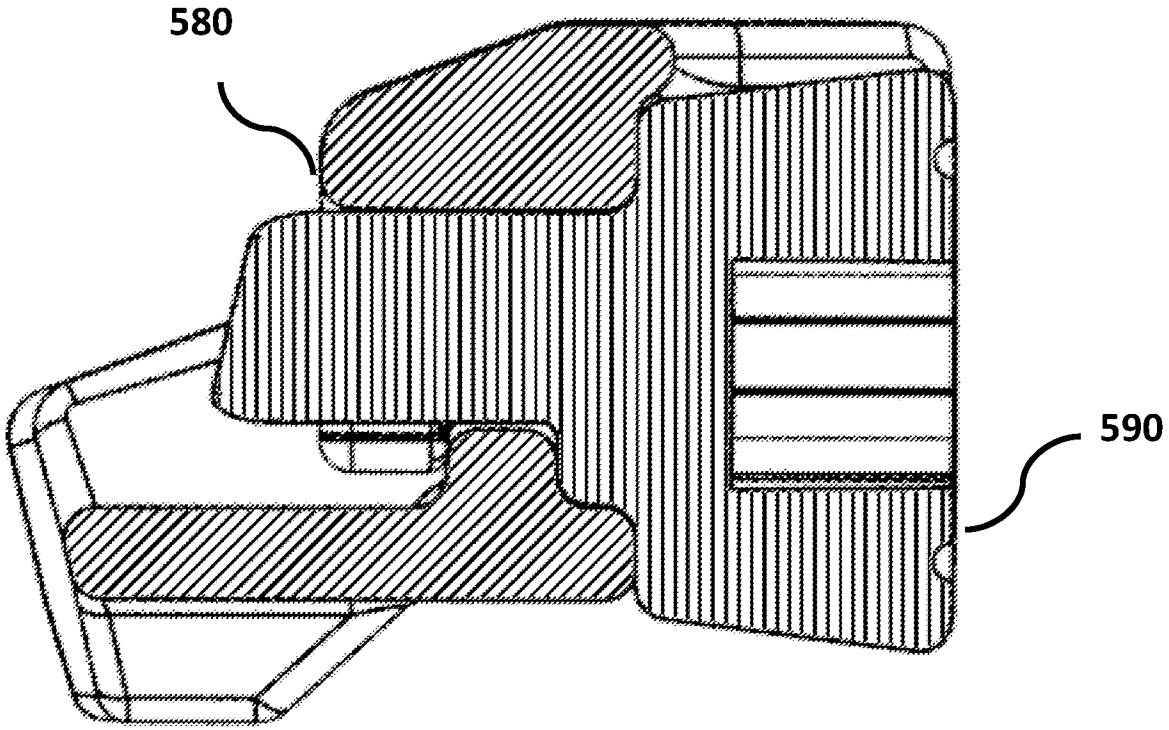
FIG. 25 of the accompanying drawings shows a cross-sectional view of a weight member and a fastener both in accordance with a further alternative embodiment of the present invention.

Referring now to FIG. 25, a sectional view of the weight member 580 and the fastener 590 is provided prior to being installed in the elongate channel 530. In this view, when the fastener 590 is midway between a locked configuration and an unlocked configuration, we can see the interface between the components better. However, to see how the weighting apparatus fits in within the channel, FIG. 26-28 have been provided below.

Figure 26:
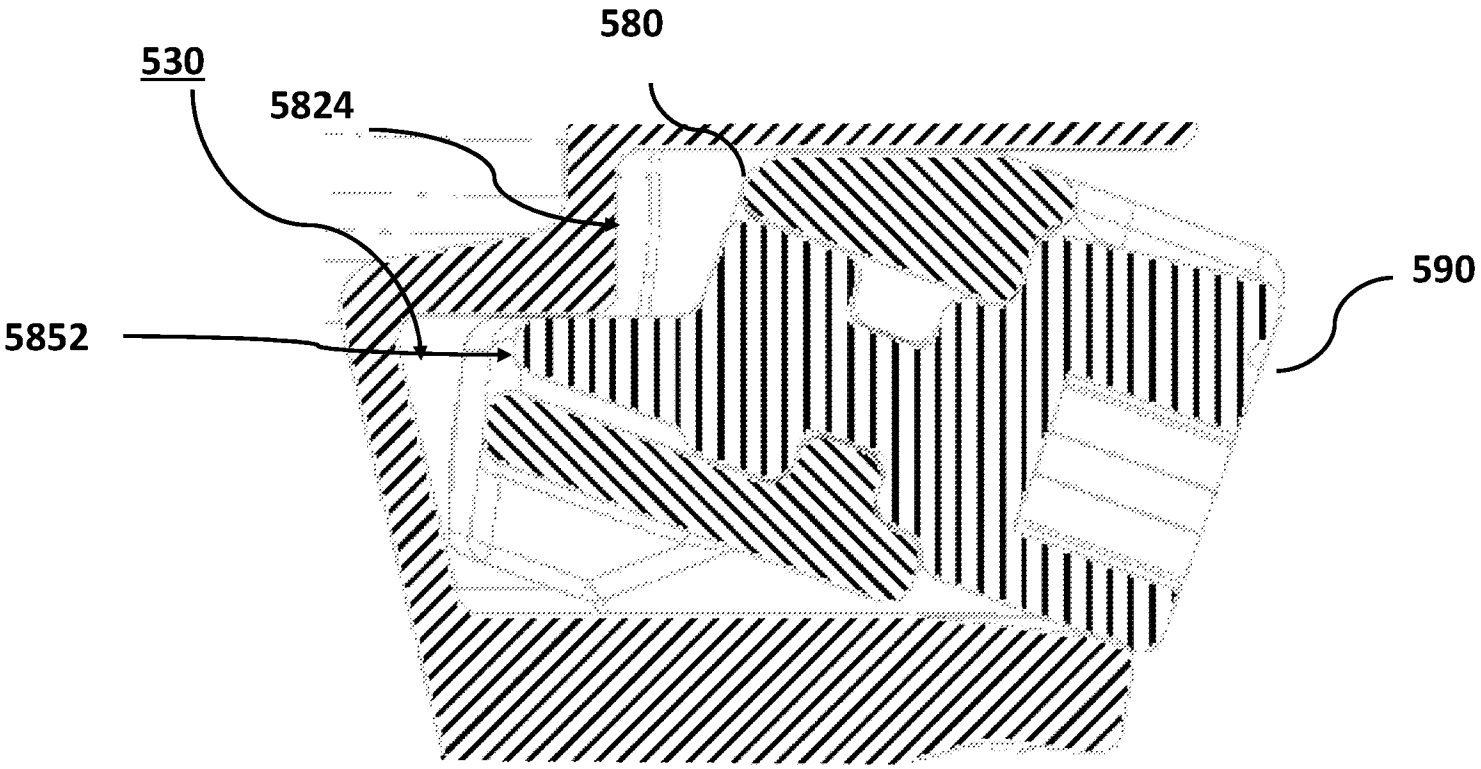
FIG. 26 of the accompanying drawings shows a cross-sectional view of an adjustable weight assembly while being installed in accordance with a further alternative embodiment of the present invention.

Referring now to FIG. 26, the fastener 590 is positioned with the elongate channel 530 angularly aligned with the locking protrusion 5852 so that the fastener 590 may be freely inserted into the fastener receiving hole 585 until the alignment portion 5921 contacts the abutment surface 5824 of the locking protrusion 5852. When in the insertion configuration, the position of the fastener 590 is angularly offset from the position of the fastener 590 when in the locked configuration and unlocked configuration. Preferably when in the insertion configuration, the fastener 590 is rotated outside of the range of motion between the locked configuration and the locked configuration. Most preferably, the fastener may be rotated half of a turn (180°) between in a first direction to transition from the unlocked configuration to the locked configuration, and the fastener may be rotated less than half of a turn in a second direction opposite the first direction to transition from the unlocked configuration to the insertion configuration.

Figure 27:
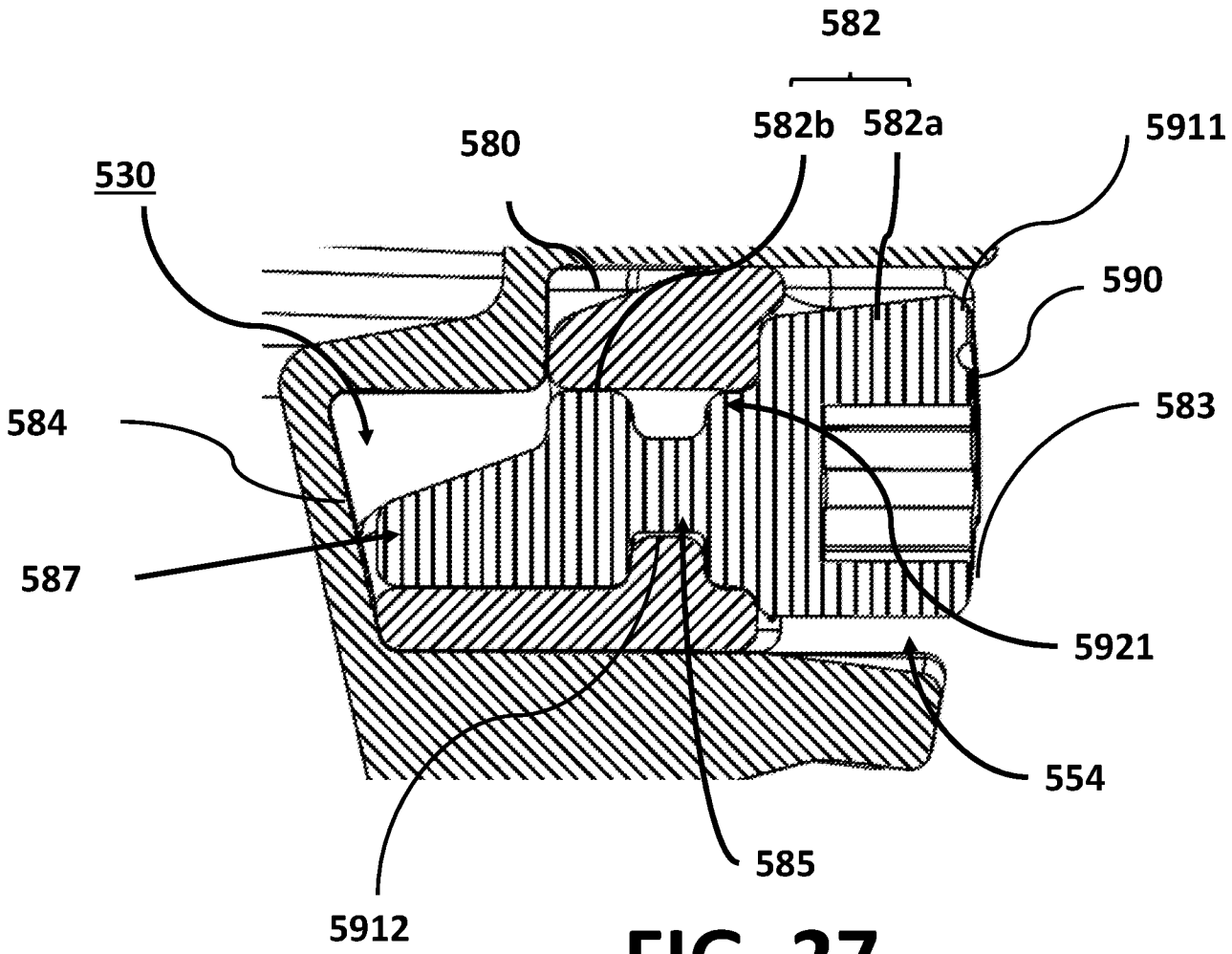
FIG. 27 of the accompanying drawings shows a cross-sectional view of an adjustable weight assembly in an installed but unlocked orientation in accordance with a further alternative embodiment of the present invention.

Referring now to FIG. 27, a modified sectional view taken along the line F-F' in FIG. 23 is provided. As shown in FIG. 27, the fastener 590 is positioned in the unlocked configuration within the weight member 580 while the weight member 580 is rotated so as to be moved within the elongate channel 530. Several features allow for the insertion of the weight member 580 and the fastener 590 to be inserted and removed from the elongate channel 530, and to be freely moved between the discrete weight positions. First, the upper surface 582 includes an outer upper surface 582*a* proximate the front surface 583 and a inner upper surface 582*b* proximate the rear surface 584. The outer upper surface 582*a* and the inner upper surface 582*b* define an angle θ. Preferably the angle θ is between 0° and 45°, more preferably the angle θ is between 10° and 40°, most preferably the angle θ is between about 15° and about 35°. The angle θ between the outer upper surface 582*a* and the inner upper surface 582*b* allows for the same rotation based insertion technique illustrated above in FIGS. 7-10. Second, the reduced radius portion 5912 is oriented distal the upper surface 582 and proximate a scalloped depression 554. The combination of the angle θ between the outer upper surface 582*a* and the inner upper surface 582*b*, the reduced radius portion 5912, and the scalloped depression 554 allow for the lower protrusions 587 to pass through the constricted entry point, even though the lower protrusions are not visible through the rib 253 from this sectional view.

Several unique features of the present invention are apparent from this sectional view. In the unlocked configuration, the fastener 590 is fully seated within the weight member 580 and the maximum radius portion 5911 of the head 591 is positioned proximate the upper wall 541. The alignment portion 5921 contacts the entire internal perimeter of the fastener receiving hole 585 to align the fastener 590 with the fastener receiving hole 585.

Figure 28:
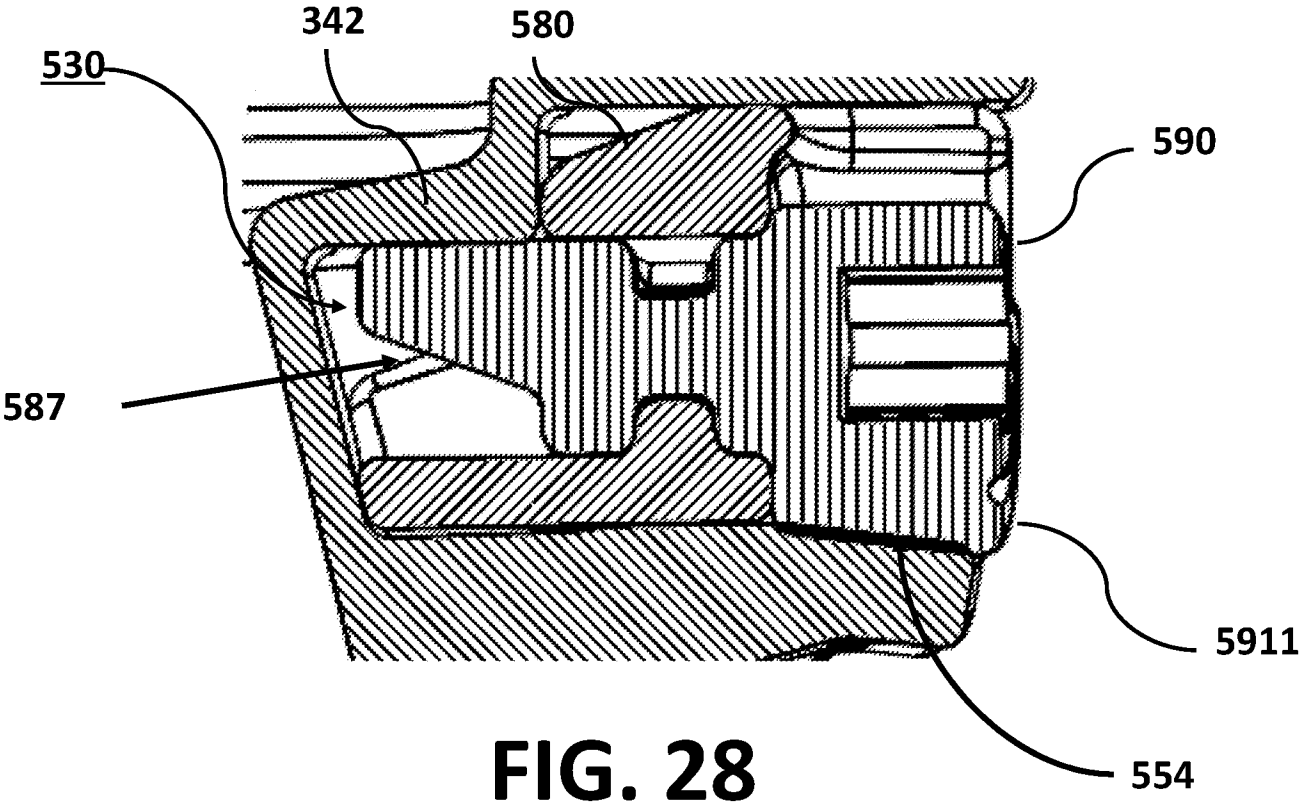
FIG. 28 of the accompanying drawings shows a cross-sectional view of an adjustable weight assembly in an installed and locked orientation in accordance with a further alternative embodiment of the present invention.

Referring now to FIG. 28, a modified sectional view taken along line G-G' in FIG. 24 is provided. As shown in FIG. 28, the fastener is now positioned in the locked configuration with the weight member 580 and the fastener 590 are now secured within each of the desired locations. The maximum radius portion 5911 of the fastener 590 is now fitted within the recessed scalloped depressions 554 to lock the weight member 580 within the elongate channel 530 to facilitate engagement of the weight member 580 in the elongate channel 530. In this locked configuration, the lower protrusion 587 is now rotated upwards towards the riser 342 to prevent the weight member 580 and fastener 590 combination from tilting up and potentially being removed.

Figure 29:
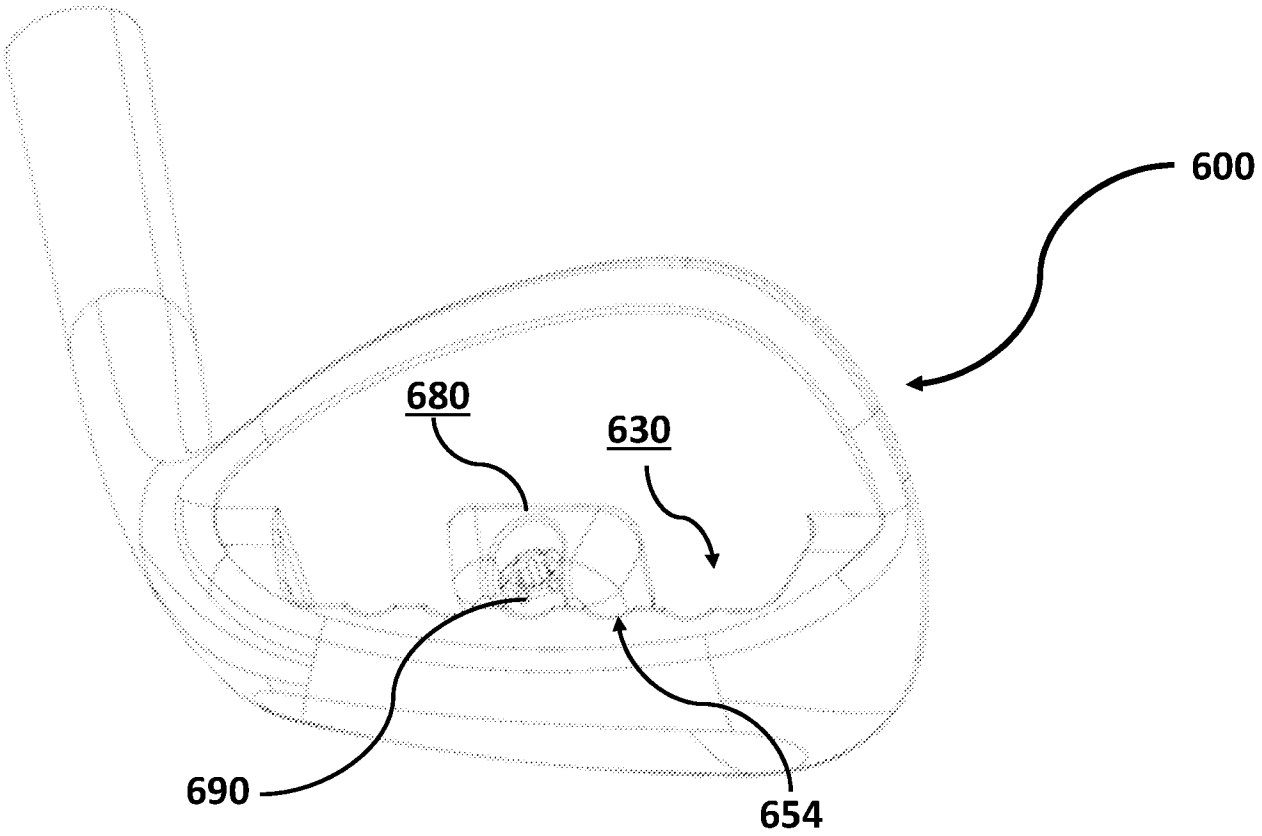
FIG. 29 of the accompanying drawings shows an iron type golf club head having an adjustable weight assembly in accordance with a further alternative embodiment of the present invention.
Figure 30:
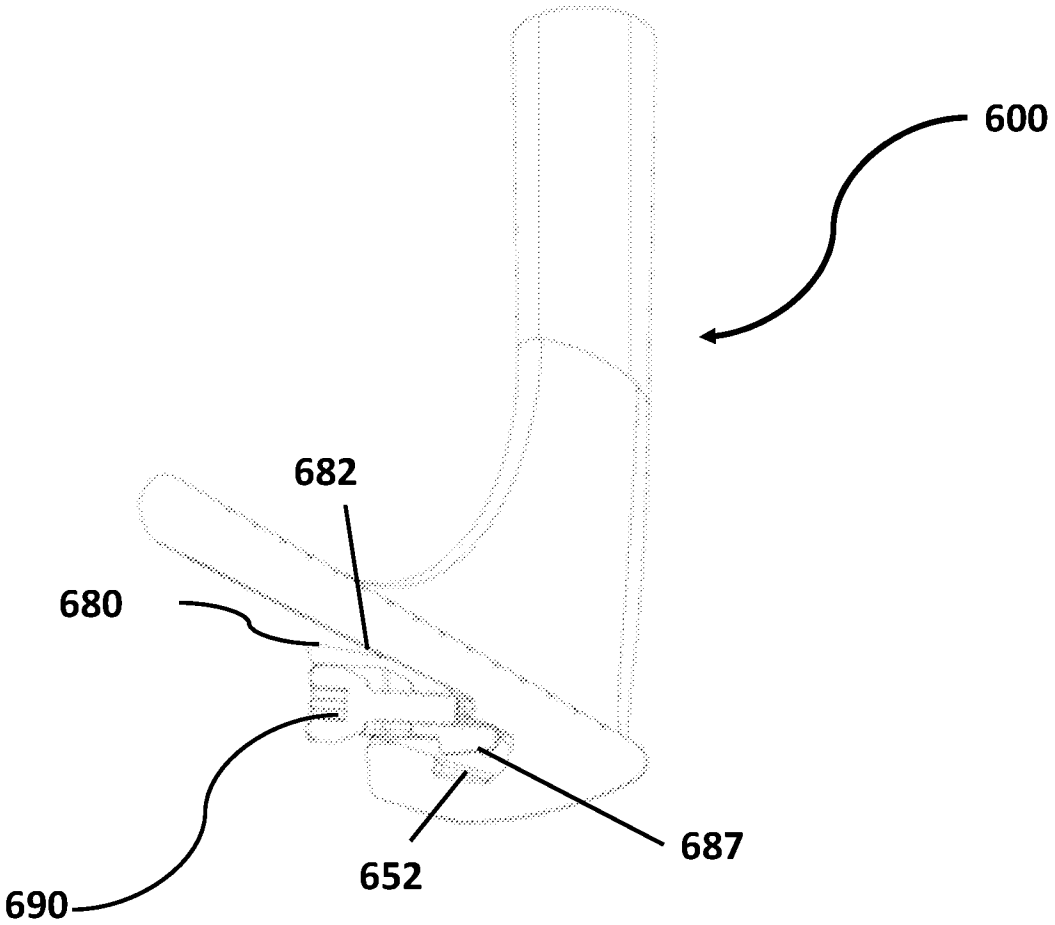
FIG. 30 of the accompanying drawings shows a cut apart sectional view of an iron type golf club head in an uninstalled orientation in accordance with a further alternative embodiment of the present invention.
Figure 31:
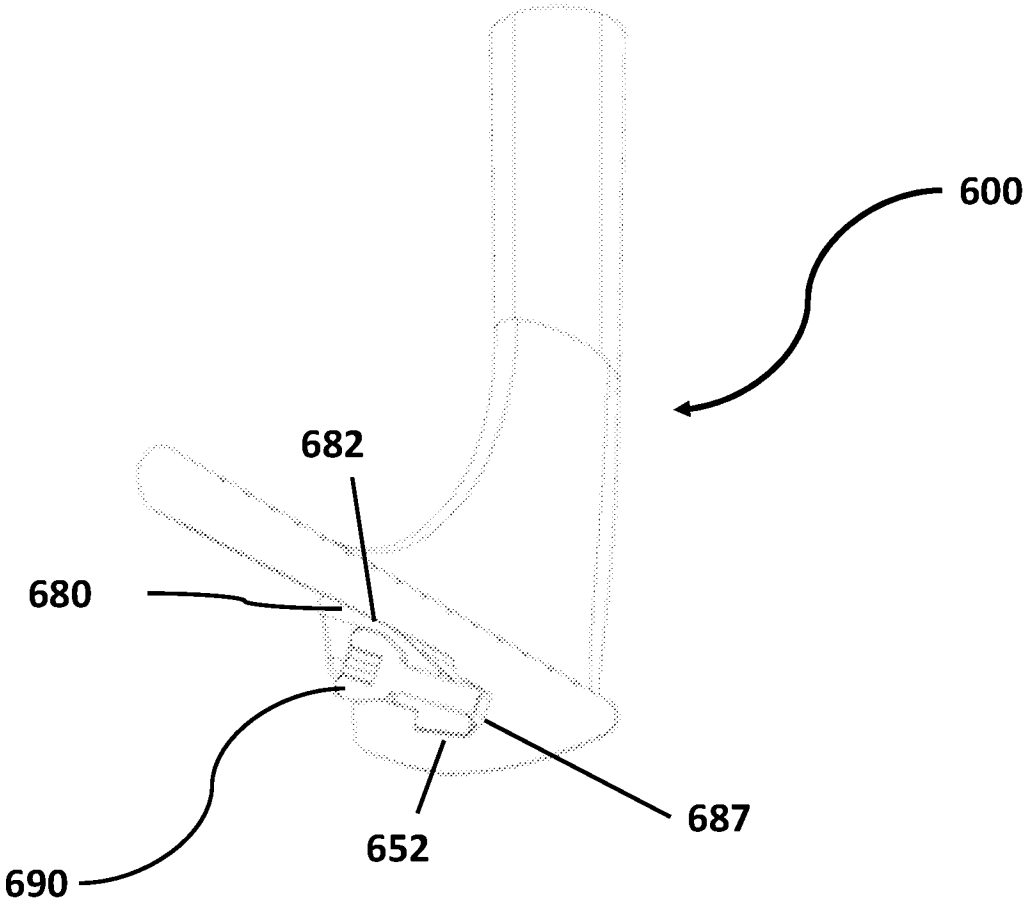
FIG. 31 of the accompanying drawing shows a cut apart sectional view of an iron type golf club head in an installed locked orientation in accordance with a further alternative embodiment of the present invention.

FIGS. 29 through 31 of the accompanying drawings shows an iron type golf club head 600 in accordance with an alternative embodiment of the present invention. In this embodiment of the present invention, a similar type of rotatable locking mechanism is used to secure a weight member 680 via a fastener 690 along the rear surface of the golf club head 600 itself.

In the rear perspective view of the golf club head 600 shown in FIG. 29, we can see that the weight member 680 and the fastener 690 secure work in conjunction to be secured in an elongate channel 630 that has a plurality of scalloped depressions 654 adapted to receive the head of the fastener 690 for retention. The details of the retention mechanism will be shown in more detail via the sectional views in FIGS. 30 and 31, but it utilizes a similar rotational attachment mechanism described in previous embodiment but adapted in an iron type chassis.

In the sectional view of the golf club head 600 shown in FIG. 30, the weight member 680 and fastener 690 are in an unlocked position with the lower protrusion 687 disengaged from the lower recess 652 to allow for insertion. The same dual angled upper surface 682 that was previously discussion will facilitate the insertion of the weight member 680 and the fastener 690 into the elongate channel 630.

FIG. 31 of the accompanying drawings shows golf club head 600 wherein the weight member 680 and the fastener 690 are now in a fully inserted locked position within the elongate channel 630. In this fully inserted and locked position, we can see that the lower protrusion 687 is not fully engaged within the lower recess 652 while the upper surface 682 works in conjunction with a fully inserted fastener 690 within the weight member 680 to fully secure the weight adjustment feature within the elongate channel 630 without departing from the scope and content of the present invention.

What is claimed is:

1. A golf club head comprising:

a striking face portion located at a frontal portion of said golf club head; and a body portion attached to a rear of said striking face portion;

wherein said body portion comprises a weight adjustment portion further comprising;

an elongate channel further comprising a plurality of discrete locations to receive a weight;

a weight member having a fastener receiving aperture, and a fastener further comprising a fastener head and a threaded shaft, wherein said fastener head is adapted to affix said weight member into said plurality of discrete locations within said elongate channel wherein said weight adjustment portion can be configured to be in either one of an unlocked configuration or a locked configuration, wherein when in said unlocked configuration, said fastener head does not contact any portion of said elongate channel, wherein when in said locked configuration, said fastener head engages a portion of said elongate channel to secure said weight at one of said plurality of discrete locations, and wherein said weight member further comprises;

an outer upper surface, and an inner upper surface, wherein said outer upper surface and said inner upper surface create an angle θ of between about 10° and about 40°.

2. The golf club head of claim 1, wherein said angle θ is between about 15° and about 30°.

3. The golf club head of claim 2, wherein said outer upper surface of said weight member is adapted to be parallel to an inner upper wall of said elongate channel when said weight member is in said locked configuration.

4. The golf club head of claim 3, wherein said elongate channel further comprises a lower recess adapted to engage a lower protrusion at a terminal end of said weight member.

5. The golf club head of claim 1, wherein said elongate channel further comprises a plurality of scalloped depressions, and wherein said fastener head is adapted to engage at least one of said plurality of scalloped depressions to affix said weight member at one of said plurality of discrete locations.

6. A golf club head comprising:

a striking face portion located at a frontal portion of said golf club head; and a body portion attached to a rear of said striking face portion;

wherein said body portion comprises a weight adjustment portion further comprising;

an elongate channel further comprising a plurality of discrete locations to receive a weight;

a weight member having a fastener receiving aperture further comprising;

an outer upper surface, and an inner upper surface, wherein said inner upper surface is disengaged from said elongate channel when said weight member is in a locked configuration and wherein only said outer upper surface engages an inner upper wall of said elongate channel when said weight member is in said locked configuration.

7. The golf club head of claim 6, wherein only said inner upper surface engages an inner upper wall of said elongate channel when said weight member is in an unlocked configuration.

8. The golf club head of claim 6, wherein said outer upper surface and said inner upper surface create an angle θ of between about 0° and about 45°.

9. The golf club head of claim 8, wherein said angle θ is between about 10° and about 40°.

10. The golf club head of claim 9, wherein said angle θ is between about 15° and about 30°.

11. The golf club head of claim 6, wherein said inner upper surface of said weight member is adapted to be parallel to an inner upper wall of said elongate channel when said weight member is in an unlocked configuration while being inserted into said elongate channel.

12. The golf club head of claim 11, wherein said outer upper surface of said weight member is adapted to be parallel to said inner upper wall of said elongate channel when said weight member is in a locked configuration.

13. The golf club head of claim 12, wherein said elongate channel further comprises a lower recess adapted to engage a lower protrusion at a terminal end of said weight member.

14. A golf club head comprising:

a striking face portion located at a frontal portion of said golf club head; and a body portion attached to a rear of said striking face portion;

wherein said body portion comprises a weight adjustment portion further comprising;

an elongate channel further comprising a plurality of discrete locations to receive a weight;

a weight member having a fastener receiving aperture, and a fastener, adapted to engage said fastener receiving aperture to secure said weight member to one of said plurality of discrete locations, wherein, when fully engaged in a locked configuration, a terminal end of said fastener prohibits said weight member from disengaging from said elongate channel, where, when disengaged in an unlocked configuration, the terminal end of said fastener is recessed within said fastener receiving aperture to allow said weight member to disengage from said elongate channel and wherein said elongate channel further comprises a plurality of scalloped depressions along a lower wall of said elongate channel, and wherein a proximal end of said fastener engages at least one of said plurality of scalloped depressions to secure said weight member within said elongate channel.

15. The golf club head of claim 14, wherein said weight member further comprises;

an outer upper surface, and an inner upper surface, wherein said outer upper surface and said inner upper surface create an angle θ of between about 0° and about 45°.

* * * * *